US009827763B2

(12) United States Patent
Togashi et al.

(10) Patent No.: US 9,827,763 B2
(45) Date of Patent: Nov. 28, 2017

(54) LIQUID EJECTING HEAD AND LIQUID EJECTING APPARATUS

(71) Applicant: SEIKO EPSON CORPORATION, Tokyo (JP)

(72) Inventors: Isamu Togashi, Matsumoto (JP); Shuji Sugawara, Sakata (JP); Yoichi Yamada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/974,692

(22) Filed: Dec. 18, 2015

(65) Prior Publication Data

US 2016/0221339 A1 Aug. 4, 2016

(30) Foreign Application Priority Data

Feb. 4, 2015 (JP) ..... 2015-020759

(51) Int. Cl.
*B41J 2/14* (2006.01)
*B41J 2/155* (2006.01)

(52) U.S. Cl.
CPC ..... *B41J 2/14233* (2013.01); *B41J 2/155* (2013.01); *B41J 2002/14362* (2013.01)

(58) Field of Classification Search
CPC .... B41J 2002/1657; B41J 2/235; B41J 2/245; B41J 2/265; B41J 2/25; B41J 2/16523
See application file for complete search history.

(56) References Cited

U.S. PATENT DOCUMENTS 6,270,191 B1 * 8/2001 Morikoshi ..... B41J 2/1433 347/22
2004/0160472 A1 * 8/2004 Khalid ..... B41J 2/16588 347/22
2008/0278537 A1 * 11/2008 Watanabe ..... B41J 2/16538 347/32
2009/0244173 A1 * 10/2009 Yokouchi ..... B41J 2/14233 347/33
2013/0215189 A1 * 8/2013 Justice ..... B41J 2/16508 347/29
2014/0111574 A1 * 4/2014 Ozawa ..... B41J 2/16535 347/26
2014/0152740 A1 * 6/2014 Yoshino ..... B41J 2/16535 347/31

FOREIGN PATENT DOCUMENTS

JP 2009-160786 A 7/2009

* cited by examiner

*Primary Examiner* — Sharon A Polk
(74) *Attorney, Agent, or Firm* — Foley & Lardner LLP

(57) ABSTRACT

A liquid ejecting head includes an ejection surface which extends in a first direction (X-direction) and on which a plurality of nozzles ejecting a liquid are distributed; and protrusion sections that are formed on the ejection surface and protrude on a liquid ejection side in which the liquid is ejected. The ejection surface has abutting regions on which a sealing body that seals the plurality of nozzles by surrounding the plurality of nozzles abuts. When projecting the abutting regions and the protrusion sections along a first direction (X-direction) on a virtual line along a second direction (Y-direction) intersecting the first direction, the protrusion sections are disposed on the ejection surface such that projection of the protrusion sections crosses a boundary of projection of the abutting regions.

13 Claims, 20 Drawing Sheets

LIQUID EJECTING HEAD AND LIQUID EJECTING APPARATUS

CROSS REFERENCES TO RELATED APPLICATIONS

This application claims priority to Japanese Patent Application No. 2015-020759 filed on Feb. 4, 2015. The entire disclosures of Japanese Patent Application No. 2015-020759 is hereby incorporated herein by reference.

BACKGROUND

1. Technical Field

The present invention relates to a technique for ejecting liquid such as ink.

2. Related Art

In a liquid ejecting technique in which liquid is ejected from a plurality of nozzles onto a medium such as a printing sheet, there is a problem that the liquid remaining in an ejection surface on which the plurality of nozzles are formed can adhere to the medium. In order to solve the above problem, for example, in a liquid ejecting apparatus disclosed in JP-A-2009-160786, movable piece sections are provided in a periphery of a nozzle forming surface, on an upstream side, and a downstream side in a transport direction of the medium in an ejecting head in which the plurality of nozzles are formed. The movable piece sections protrude on the medium side with respect to the nozzle forming surface.

However, in the technique disclosed in JP-A-2009-160786, since the movable piece sections are provided in the periphery of the nozzle forming surface, as a line head, if the nozzle forming surface extends and an area thereof is increased, there is a problem that contact of the medium with the nozzle forming surface cannot be effectively suppressed.

SUMMARY

An advantage of some aspects of the invention is to effectively reduce contact of a medium with an ejection surface in which a plurality of nozzles are provided.

Aspect 1

According to a preferable aspect (aspect 1) of the invention, there is provided a liquid ejecting head including an ejection surface which extends in a first direction and on which a plurality of nozzles ejecting a liquid are distributed; and protrusion sections that are formed on the ejection surface and protrude toward a liquid ejection side in which the liquid is ejected. The ejection surface has abutting regions on which a sealing body that seals the plurality of nozzles by surrounding the plurality of nozzles abuts. When projecting the abutting regions and the protrusion sections along a first direction on a virtual line along a second direction intersecting the first direction, the protrusion sections are disposed such that projection of the protrusion sections crosses a boundary of projection of the abutting regions. In the aspect 1, the protrusion sections protruding toward the liquid ejection side is formed on the ejection surface (for example, if there is a fixing plate fixing a nozzle plate in which the nozzles are formed, it is a surface of the fixing plate on the liquid ejection side, and if there is no fixing plate, it may be a surface on the liquid ejection side of the nozzle plate). Thus, even if the medium is deformed (curled) and is closer to the ejection surface, the protrusion sections become a hindrance and the medium cannot reach the ejection surface.

Furthermore, in the aspect 1, when projecting the abutting regions of the ejection surface on which the sealing body abut and the protrusion sections along the first direction on the virtual line along the second direction intersecting (orthogonal or inclined) the first direction, the protrusion sections are disposed such that projection of the protrusion sections crosses the boundary of projection of the abutting regions. Thus, the protrusion sections become the hindrance and it is possible to effectively reduce the contact of the medium with the abutting regions of the ejection surface. Thus, even if ink adheres (remains) to the abutting region of the ejection surface, it is possible to effectively reduce the adhering of the ink to the medium. Moreover, the protrusion sections may be integrally formed with the ejection surface or may be separated from the ejection surface.

Aspect 2

In a preferable example (aspect 2) according to the aspect 1, a plurality of abutting regions may be disposed along the first direction and the protrusion section may be formed between adjacent abutting regions. In the aspect 2, the plurality of abutting regions are disposed along the first direction and the protrusion section is formed between adjacent abutting regions. Thus, it is possible to effectively reduce the adhering of the ink remaining in each abutting region to the medium by the protrusion section formed between the abutting regions while maintaining sealing performance between each sealing body and the ejection surface. In this case, since the number of the abutting regions increases as the number of the sealing bodies increases, it is possible to increase the number of the protrusion sections provided therebetween. Thus, it is possible to enhance an effect of reducing adhesion of ink to the medium.

Aspect 3

In a preferable example (aspect 3) according to the aspect 1 or 2, a plurality of protrusion sections may be formed on the ejection surface and when each protrusion section is projected along the first direction on the virtual line, the continuous projection of the protrusion sections may be formed. In the aspect 3, when the plurality of protrusion sections formed on the ejection surface is projected on the virtual line, the continuous projection of the protrusion sections is formed. Thus, even if the medium is closer to the ejection surface, it is possible to reduce the contact of the medium with the ejection surface by allowing the medium to come into contact with one of the plurality of protrusion sections. Therefore, it is possible to effectively reduce contact of the medium over a wide range of the ejection surface.

Aspect 4

In a preferable example (aspect 4) according to any one of the aspects 1 to 3, the protrusion sections may include the protrusion sections that are formed in an inside region surrounded by the abutting region and the protrusion sections that are formed in an outside region surrounded by the abutting region in the ejection surface. In the aspect 4, the protrusion sections are also formed in the inside region of the abutting region in which the nozzles are disposed. Thus, it is possible to dispose the protrusion sections on the inside region closer to the nozzles than the protrusion sections of the outside region. Thus, since it is possible to enhance an effect of reducing the contact of the medium with the nozzle of the ejection surface, it is possible to enhance an effect of reducing adhesion of ink remaining in the nozzles to the medium.

Aspect 5

In a preferable example (aspect 5) according to the aspect 2 or 3, when each protrusion section formed in each of the inside region and the outside region surrounded by the abutting region is projected along the first direction on the virtual line, the continuous projection of the protrusion sections may be formed. In the aspect 5, when each protrusion section formed in each of the inside region and the outside region surrounded by the abutting region is projected along the first direction on the virtual line, the continuous projection of the protrusion sections is formed. Thus, even if the medium is closer to the ejection surface, it is possible to reduce the contact of the medium with the ejection surface by allowing the medium to come into contact with one of all protrusion sections also including the protrusion sections formed on the inside of the abutting region. Therefore, it is also possible to effectively reduce adhesion of ink remaining in the nozzles to the medium in addition to the ink remaining in the abutting region.

Aspect 6

In a preferable example (aspect 6) according to any one of the aspects 3 to 5, the protrusion sections respectively may have the same height from the ejection surface. In the aspect 6, the protrusion sections respectively have the same height from the ejection surface. Thus, it is possible to reduce the contact of the medium with the ejection surface without widening a distance between the ejection surface and the medium. That is, if the distance (so-called platen gap) between the ejection surface and the medium is wide, an error of a position in which the liquid is landed from the nozzle on the surface of the medium becomes particularly apparent. However, it is possible to prevent the medium from coming into contact with the ejection surface while preventing the error.

Aspect 7

In a preferable example (aspect 7) according to any one of the aspects 1 to 6, a plurality of opening sections exposing the nozzle plate in which the nozzles are provided on the liquid ejection side may be provided on the ejection surface and the protrusion section that is disposed so as to cross a boundary of projection of the abutting region may be formed between the plurality of opening sections. In the aspect 7, the protrusion section disposed so as to cross the boundary of projection of the abutting region is formed between the plurality of opening sections. Thus, the protrusion section can have a function to reduce adhesion of the ink remaining within the opening section to the medium. Moreover, if the plurality of protrusion sections are formed in the ejection surface, at least one of the protrusion sections may be formed between the plurality of opening sections.

Aspect 8

In a preferable example (aspect 8) according to the aspect 7, the protrusion section disposed between the plurality of opening sections may be the longest of the plurality of protrusion sections. In the aspect 8, the protrusion section disposed between the plurality of opening sections on the ejection surface is the longest of the plurality of protrusion sections. Thus, since the protrusion section is bead processing, it is possible to effectively correct warpage of the ejection surface generated by press processing, for example, by the effect of bead processing when forming the opening section.

Aspect 9

According to a preferable aspect (aspect 9) of the invention, there is provided a liquid ejecting apparatus including a transport mechanism that transports a medium in a transport direction of the medium; and a liquid ejecting head that ejects a liquid onto the medium that is transported in the transport direction of the medium. The liquid ejecting head includes an ejection surface in which a plurality of nozzles ejecting the liquid are distributed in a direction orthogonal to the transport direction of the medium, and protrusion sections that are formed on the ejection surface and protrude on the liquid ejection side on which the liquid is ejected. The ejection surface has abutting regions on which a sealing body which seals the plurality of nozzles by surrounding the plurality of nozzles abuts. When projecting the abutting regions and the protrusion sections on a virtual line along the transport direction of the medium, the protrusion sections are disposed such that projection of the protrusion sections crosses a boundary of projection of the abutting regions. In the aspect 9, when projecting the abutting regions of the ejection surface on which the sealing body abuts and the protrusion sections on the virtual line along the second direction intersecting (orthogonal or inclined) the first direction, the protrusion sections are disposed such that projection of the protrusion sections crosses the boundary of projection of the abutting regions. Thus, the protrusion sections become a hindrance and it is possible to effectively reduce the contact of the medium with the ejection surface. Thus, even if ink remains in the abutting region of the ejection surface, it is possible to effectively reduce the adhering of the ink to the medium. The preferable example of the liquid ejecting apparatus is a printing apparatus ejecting ink onto the medium such as a printing sheet, but usage of the liquid ejecting apparatus according to the invention is not limited to the print.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
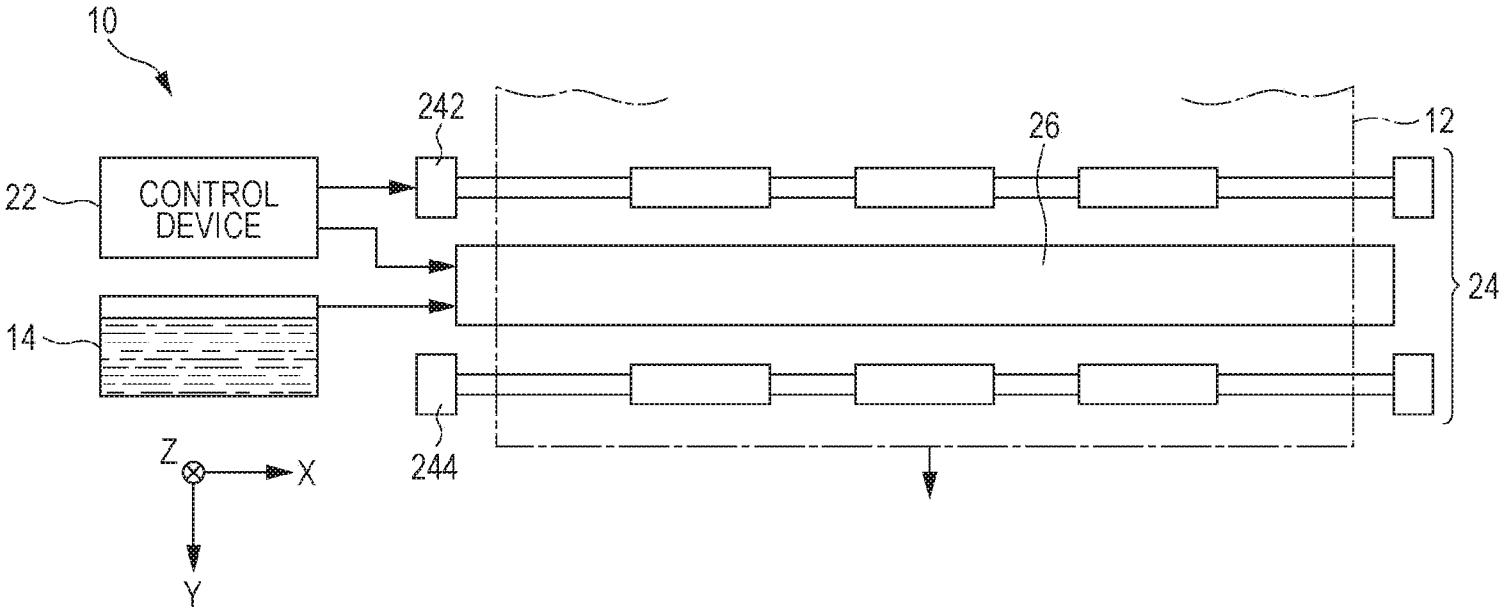
FIG. 1 is a configuration view of a printing apparatus to which a liquid ejecting head according to a first embodiment of the invention can be applied.

First, a liquid ejecting apparatus according to a first embodiment of the invention will be described by taking an ink jet type printing apparatus as an example. FIG. 1 is a partial configuration view of an ink jet type printing apparatus 10 according to the first embodiment of the invention. The printing apparatus 10 of the first embodiment is a liquid ejecting apparatus ejecting ink that is an example of a liquid onto a medium (ejection target) 12 such as a printing sheet and includes a control device 22, a transport mechanism 24, and a liquid ejecting unit 26. A liquid container (cartridge) 14 for storing the ink is mounted on the printing apparatus 10.

Figure 2:
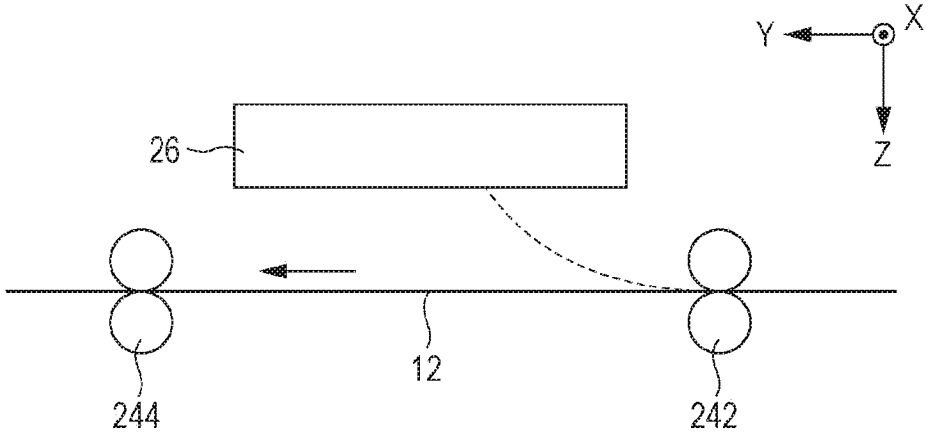
FIG. 2 is an explanatory view of an operation of the printing apparatus illustrated in FIG. 1 and is a view obtained by focusing on transport of a medium.

The control device 22 collectively controls each element of the printing apparatus 10. The transport mechanism 24 transports the medium 12 in a Y-direction under control of the control device 22. FIG. 2 is a configuration view of the printing apparatus 10 that focuses on the transport of the medium 12. As illustrated in FIGS. 1 and 2, the transport mechanism 24 includes first rollers 242 and second rollers 244. The first rollers 242 are disposed on a negative side (upstream side in a transport direction of the medium 12) in the Y-direction when viewed from the second rollers 244 and transports the medium 12 on the second rollers 244 side. The second rollers 244 transports the medium 12 supplied from the first rollers 242 on a positive side in the Y-direction. However, a structure of the transport mechanism 24 is not limited to the example described above.

As illustrated by a broken line in FIG. 2, the medium 12 may be deformed (for example, curled) on the liquid ejecting unit 26 side between the first rollers 242 and the second rollers 244. For example, if it is assumed that the ink is ejected onto both sides (two-sided printing) of the medium 12 by sequentially reversing the medium 12, the deformation of the medium 12 becomes particularly apparent in a state where the ink is ejected onto only one surface. If the ink is sufficiently dried in a state where one surface is printed, the deformation of the medium 12 may be suppressed, but, for example, when performing printing at high speed in which a plurality of medium 12 are printed in a short time period, it is actually difficult to ensure a sufficient drying time and it is necessary to transport the medium 12 in a state of being deformed on the liquid ejecting unit 26 side by the transport mechanism 24.

Figure 3:
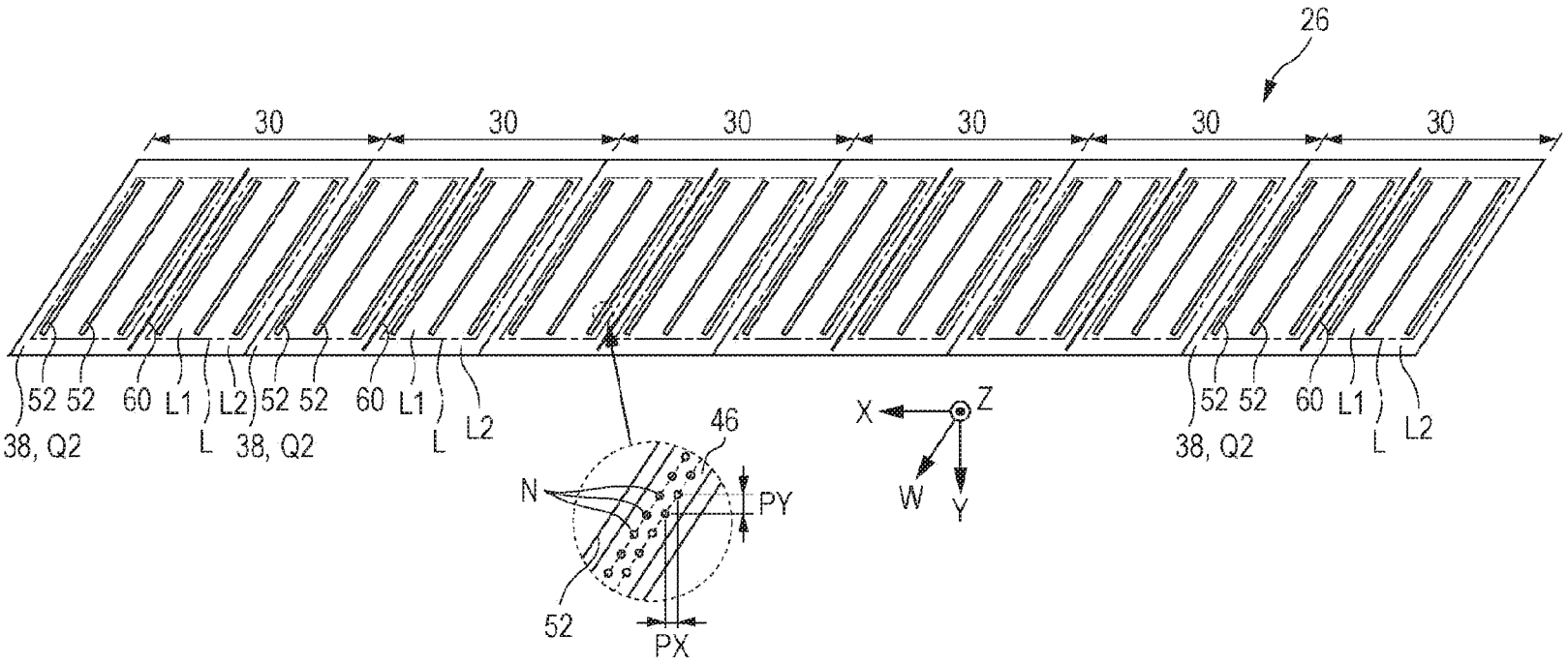
FIG. 3 is a plan view illustrating a configuration of a surface facing the medium in a liquid ejecting unit according to the first embodiment.

The liquid ejecting unit 26 of FIG. 1 ejects the ink supplied from the liquid container 14 onto the medium 12 under the control of the control device 22. The liquid ejecting unit 26 of the first embodiment is a line head elongated in an X-direction (first direction) orthogonal to the Y-direction. FIG. 3 is a plan view of an ejection surface (nozzle surface) that is a surface facing the medium 12 in the liquid ejecting unit 26. As illustrated in FIG. 3, an ejection surface of the liquid ejecting unit 26 extends in one direction (longitudinal direction) and on which a plurality of nozzles (ejecting holes) N are distributed and provided. The liquid ejecting unit 26 is disposed such that the ejection surface faces the medium 12 at predetermined intervals in a state where the ejection surface is parallel to an X-Y plane. The liquid ejecting unit 26 ejects the ink onto the medium 12 in parallel to the transport of the medium 12 by the transport mechanism 24 and thereby a desired image is formed on a surface of the medium 12. Moreover, hereinafter, a direction perpendicular to the X-Y plane (for example, a plane parallel to the surface of the medium 12 having no deformation) is referred to as a Z-direction. An ejecting direction (for example, downward in the vertical direction) of the ink by the liquid ejecting unit 26 corresponds to the Z-direction. Furthermore, a longitudinal direction in which the ejection surface of the liquid ejecting unit 26 extends corresponds to the X-direction and a lateral direction of the ejection surface corresponds to the Y-direction.

As illustrated by the broken line in FIG. 2, in a situation in which the deformed medium 12 is transported, the medium 12 may come into contact with the ejection surface of the liquid ejecting unit 26. In this case, when the ink remains in the ejection surface, there is a possibility that the ink adheres to the medium 12. Thus, in the embodiment, the medium 12 does not come into contact with the ejection surface by forming a protrusion section protruding from the ejection surface and thereby it is possible to effectively reduce adhering of the ink to the medium 12.

The liquid ejecting unit 26 of the first embodiment including the liquid ejecting head in which such a protrusion section is formed will be described. FIG. 3 is a view describing a configuration example of the liquid ejecting unit 26 of the first embodiment and a plan view illustrating a surface (ejection surface) facing the medium 12. As illustrated in FIG. 3, the liquid ejecting unit 26 of the first embodiment includes a plurality (six in the first embodiment) of liquid ejecting heads 30. Each liquid ejecting head 30 ejects the ink supplied from the liquid container 14 from the plurality of nozzles N. As illustrated in FIG. 3, the plurality of liquid ejecting heads 30 are fixed to a housing (not illustrated) of the liquid ejecting unit 26 in a state of being arranged in the X-direction.

Each liquid ejecting head 30 is a flat plate defining the ejection surface and includes a fixing plate 38 that exposes and fixes a nozzle plate 46 forming the plurality of nozzles N. Protrusion sections 60 are formed in the fixing plate 38 so as to protrude on a positive side in the Z-direction in FIG. 3, that is, a side (hereinafter, described as "liquid ejection side") in which the liquid is ejected from the plurality of nozzles N. A plurality of opening sections 52 in which the nozzle plates 46 are exposed and disposed are formed in the fixing plate 38 of each liquid ejecting head 30 and the protrusion section 60 is formed between the opening sections 52. The liquid ejecting unit 26 illustrated in FIG. 3 is an example of a case where one protrusion section 60 is disposed for each liquid ejecting head 30.

In such a liquid ejecting unit 26, if the ink is supplied from the liquid container 14 to each liquid ejecting head 30, the ink is ejected from the plurality of nozzles N and as illustrated in FIG. 2, the ink adheres to the medium 12 that is transported by facing the liquid ejecting unit 26. In this case, even though the medium 12 is curled and then the medium 12 gets close to the ejection surface of the fixing plate 38 of the liquid ejecting head 30, since the protrusion sections 60 protrudes from the fixing plate 38 on the liquid ejection side, the medium 12 cannot come into contact with the ejection surface of the fixing plate 38. Thus, it is possible to effectively reduce adhering of the ink to the medium 12.

Figure 4:
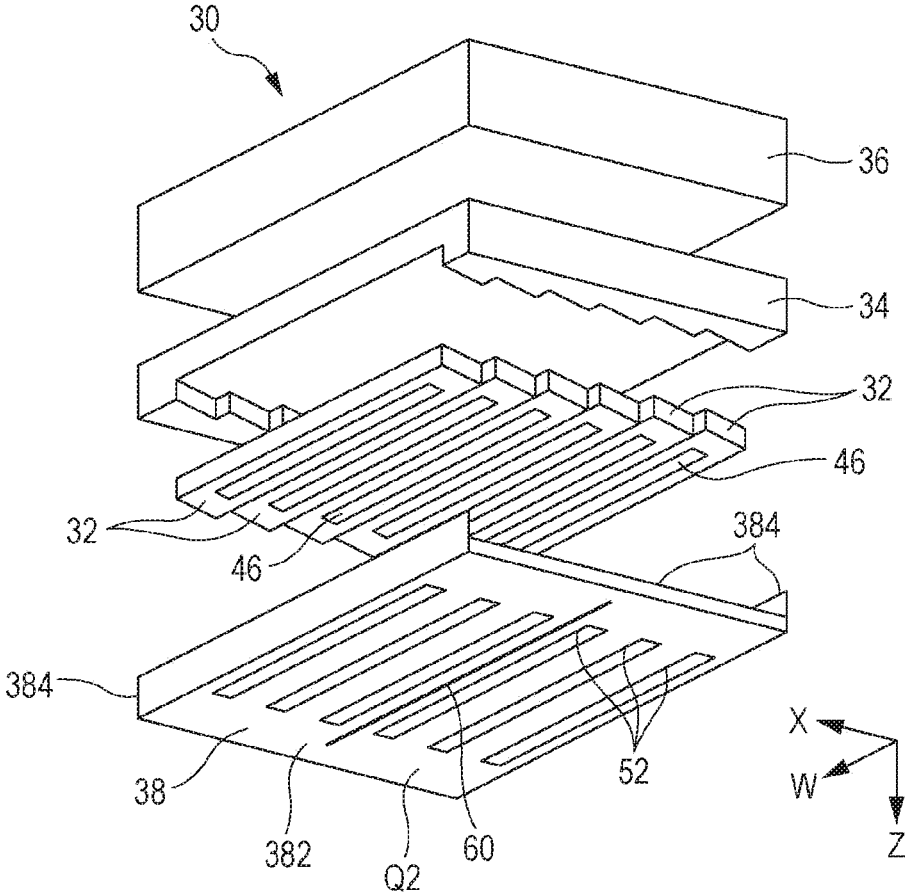
FIG. 4 is an exploded perspective view illustrating one configuration example of the liquid ejecting head in the liquid ejecting unit illustrated in FIG. 3.

Next, a configuration example of the liquid ejecting head 30 illustrated in FIG. 3 will be described in detail with reference to FIG. 4. FIG. 4 is an exploded perspective view of the liquid ejecting head 30 configuring the liquid ejecting unit 26. Moreover, since all the plurality of liquid ejecting heads 30 illustrated in FIG. 3 have the same configuration, one of the liquid ejecting heads 30 will be described here. As illustrated in FIG. 4, the liquid ejecting head 30 of the first embodiment includes a plurality (six in the first embodiment) of liquid ejection sections 32, a support body 34, a flow path structure 36, and the fixing plate 38. The support body 34 is a housing accommodating and supporting the plurality of liquid ejection sections 32 and, for example, is formed by injection molding of a resin material or die-casting molding of a metal material. The flow path structure 36 is a structure in which the flow path for distributing the ink supplied from the liquid container 14 to the plurality of liquid ejection sections 32 and, for example, includes a valve structure for controlling opening and closing, or a pressure of the flow path and a filter for collecting air bubbles or foreign matters mixed in the ink within the flow path. Moreover, it is possible to integrally form the support body 34 and the flow path structure 36.

Each liquid ejection section 32 is configured as a head chip ejecting the ink from the plurality of nozzles N. As illustrated in FIG. 3, the plurality of nozzles N of each liquid ejection section 32 are arranged in two rows along a W-direction intersecting the X-direction. As illustrated in FIG. 3, the W-direction of the first embodiment is a direction inclined at a predetermined angle (for example, an angle within a range of 30° or more and 60° or less) with respect to the X-direction and the Y-direction within the X-Y plane. In the first embodiment, as illustrated in FIG. 3, positions of the plurality of nozzles N are selected such that a pitch (specifically, a distance between centers of the nozzles N) PX in the X-direction is narrower than a pitch PY in the Y-direction (PX<PY). As illustrated above, in the first embodiment, since the plurality of nozzles N are arranged in the W-direction inclined with respect to the Y-direction in which the medium 12 is transported, it is possible to increase effective resolution (dot density) of the medium 12 in the X-direction, for example, compared to a configuration in which the plurality of nozzles N are arranged in the X-direction.

Figure 5:
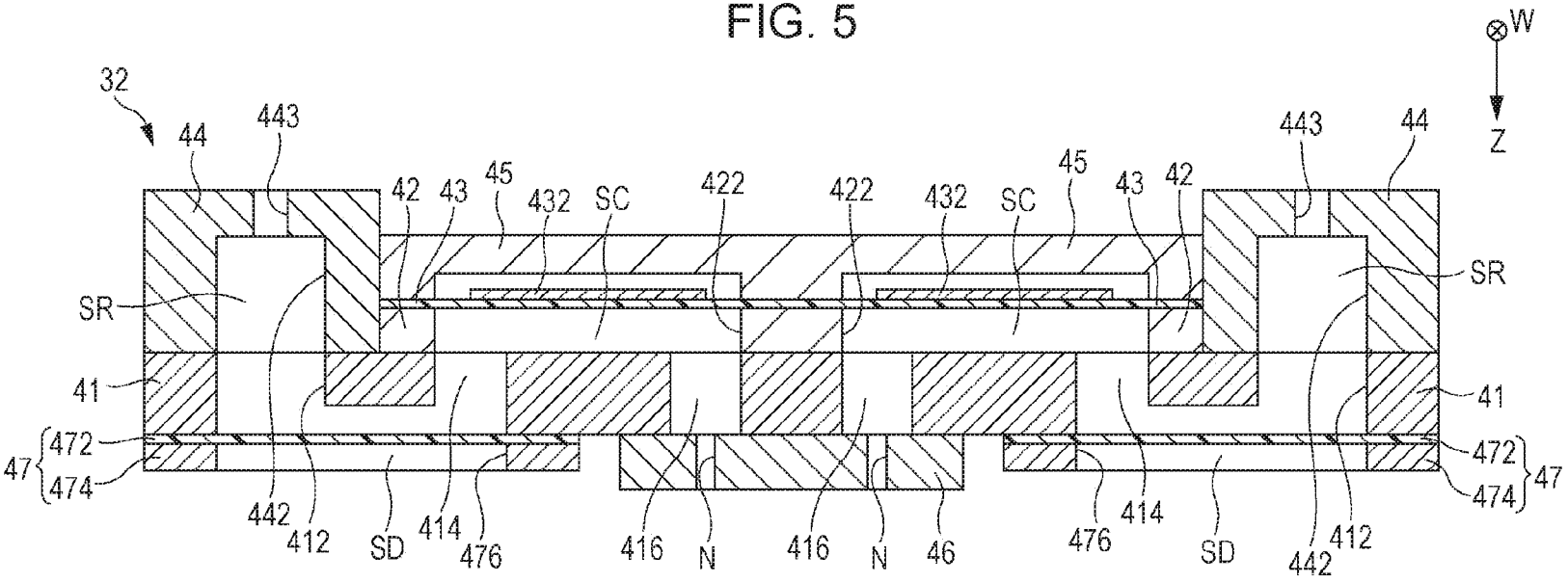
FIG. 5 is a cross-sectional view of a liquid ejection section illustrated in FIG. 4.

Here, a configuration example of the liquid ejection section 32 illustrated in FIG. 4 will be described in detail with reference to FIG. 5. Moreover, since all the plurality of liquid ejection sections 32 illustrated in FIG. 4 have the same configuration, one of the liquid ejection sections 32 will be described here. FIG. 5 is a sectional view illustrating a cross section configuration of the liquid ejection section 32 orthogonal to the W-direction. As illustrated in FIG. 5, the liquid ejection section 32 of the first embodiment is a laminated structure. Here, the liquid ejection section 32 includes two nozzles N and is configured such that structures supplying and ejecting the liquid to each nozzle N are respectively disposed in line symmetry with respect to a symmetry axis parallel to the W-direction. However, the liquid ejection section 32 is not necessarily limited to the structure and may be formed of a structure corresponding to one nozzle N, or may be a structure in which the nozzles N are arranged zigzag between two rows in the W-direction. The liquid ejection section 32 includes a flow path substrate 41 as one example of the flow path member. A pressure chamber substrate 42, a vibration plate 43, a housing 44, and a sealing plate 45 are disposed on one side (negative side in the Z-direction) of the flow path substrate 41. The nozzle plate 46 and a compliance section 47 are disposed on the other side of the flow path substrate 41. Each element of the liquid ejection sections 32 is a substantially flat member that is substantially long in the W-direction and the elements are fixed to each other, for example, by adhesive.

The nozzle plate 46 of FIG. 5 is a substrate in which the plurality of nozzles N are formed. The nozzle plate 46 of the first embodiment is a flat plate that is long in the W-direction also as illustrated in FIG. 4 and, for example, is formed of a silicon single crystal substrate. Specifically, as illustrated in FIG. 3, the plurality of nozzles N arranged in the two rows in the W-direction are formed in the nozzle plate 46 of each liquid ejection section 32.

The flow path substrate 41 of FIG. 5 is a flat plate configuring the flow path of the ink. An opening section 412, a supply flow path 414, and a communication flow path 416 are formed in the flow path substrate 41 of the first embodiment. The supply flow path 414 and the communication flow path 416 are through-holes formed for each nozzle N and the opening section 412 is a through-hole which is continuous over the plurality of nozzles N. A space that allows an accommodating section (concave section) 442 formed in the housing 44 and the opening section 412 of the flow path substrate 41 functions as a storage chamber (reservoir) SR storing the ink supplied from the liquid container 14 through an introduction flow path 443 of the housing 44.

The compliance section 47 of FIG. 5 is an element for suppressing pressure variation of the ink within the storage chamber SR and includes an elastic film 472 and a support plate 474. The elastic film 472 is a flexible member formed in a film shape and configures a wall surface (specifically, a bottom surface) of the storage chamber SR. The support plate 474 is a flat plate formed of a material having high rigid such as stainless steel and supports the elastic film 472 on the surface of the flow path substrate 41 such that the opening section 412 of the flow path substrate 41 is closed by the elastic film 472. An opening section 476 is formed in a region overlapping the storage chamber SR in the support plate 474 while interposing the elastic film 472 therebetween. The elastic film 472 is deformed depending on the pressure of the ink within the storage chamber SR in a space (hereinafter, referred to as "damper chamber") SD on an inside of the opening section 476 of the support plate 474 and thereby the pressure variation within the storage chamber SR is suppressed (absorbed). That is, the damper chamber SD functions as a space for deforming the elastic film 472 so that the pressure variation within the storage chamber SR is absorbed.

An opening section 422 is formed in the pressure chamber substrate 42 of FIG. 5 for each nozzle N. The vibration plate 43 is a flat plate to be elastically vibrated and is fixed to a surface on a side opposite to the flow path substrate 41 in the pressure chamber substrate 42. A space interposed between the vibration plate 43 and the flow path substrate 41 on an inside of each opening section 422 of the pressure chamber substrate 42 functions as a pressure chamber (cavity) SC which is filled with the ink supplied from the storage chamber SR through the supply flow path 414. Each pressure chamber SC communicates with the nozzle N through the communication flow path 416 of the flow path substrate 41. Furthermore, a piezoelectric element 432 is formed on a surface of the vibration plate 43 on a side opposite to the pressure chamber substrate 42 for each nozzle N. Each piezoelectric element 432 is a driving element where a piezoelectric layer is interposed between electrode layers facing each other. A plurality of piezoelectric elements 432 are sealed by the sealing plate 45.

Figure 6:
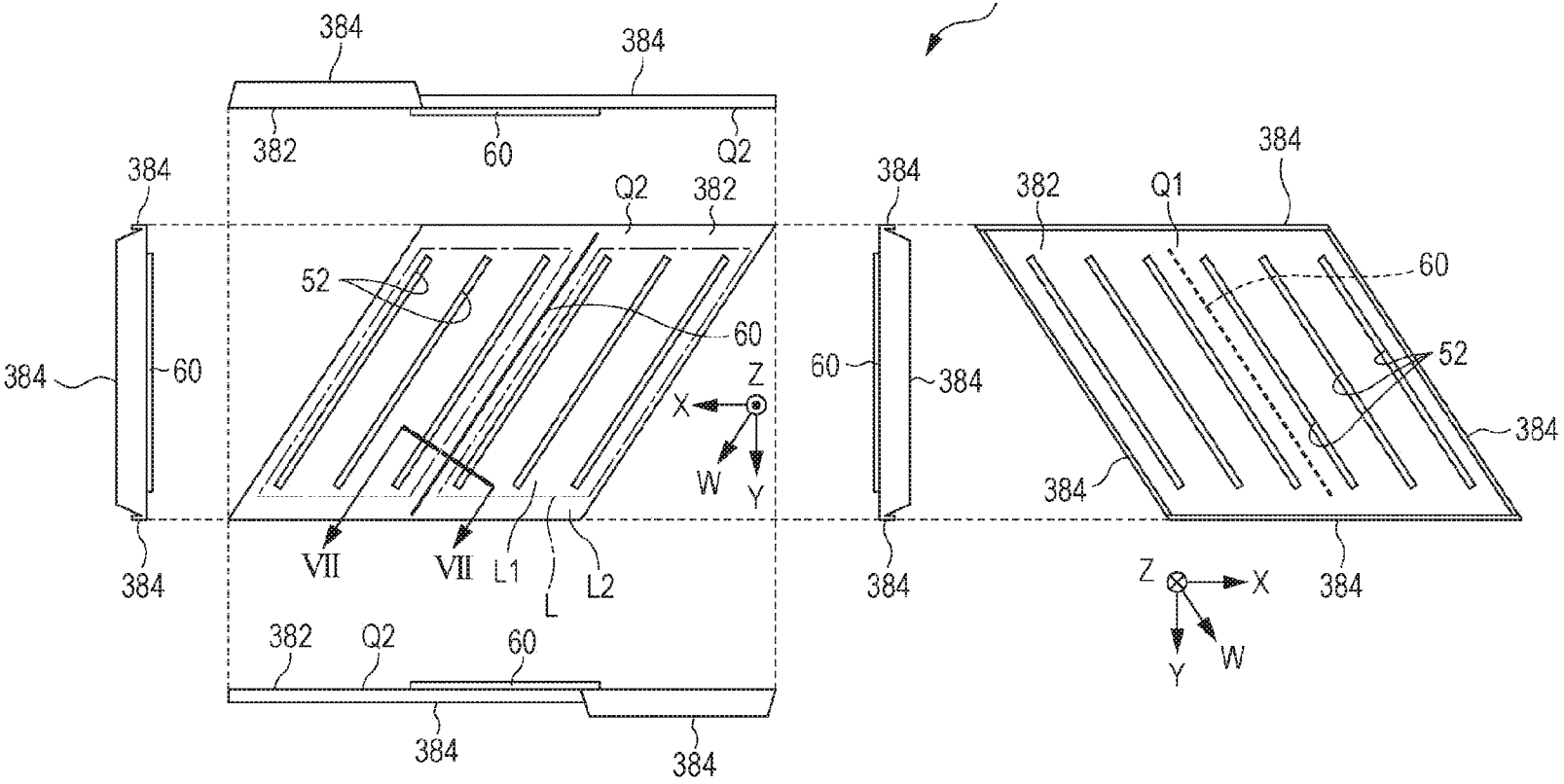
FIG. 6 is a six-orthogonal view illustrating a configuration example of a fixing plate illustrated in FIG. 4.

The plurality of liquid ejection sections 32 having the structure illustrated above are fixed to the fixing plate 38 of FIG. 4. FIG. 6 is a configuration view (six-orthogonal view) of the fixing plate 38. As illustrated in FIGS. 4 and 6, the fixing plate 38 of the first embodiment includes a support section 382 and a plurality of peripheral sections 384. The support section 382 is a flat plate-shaped portion including a first surface Q1 and a second surface Q2 positioned on opposite sides to each other. As illustrated in FIG. 6, the support section 382 of the first embodiment is formed in a rectangular shape (specifically, parallelogram-shaped) that is defined by a pair of edges extending in the W-direction and a pair of edges extending in the X-direction. The first surface Q1 of the support section 382 is a surface on the negative side in the Z-direction and the second surface Q2 is a surface on the positive side (medium 12 side) in the Z-direction. The second surface Q2 of the support section 382 is water-repellent processed. On the other hand, each peripheral section 384 is a portion that is continuous to each edge of the support section 382 and is bent on the negative side in the Z-direction so as to be substantially orthogonal to the first surface Q1 or the second surface Q2 of the support section 382. For example, the support section 382 and the plurality of peripheral sections 384 are integrally configured by bending the flat plate that is molded in a predetermined shape by a material having high rigidity such as stainless steel.

Figure 7:
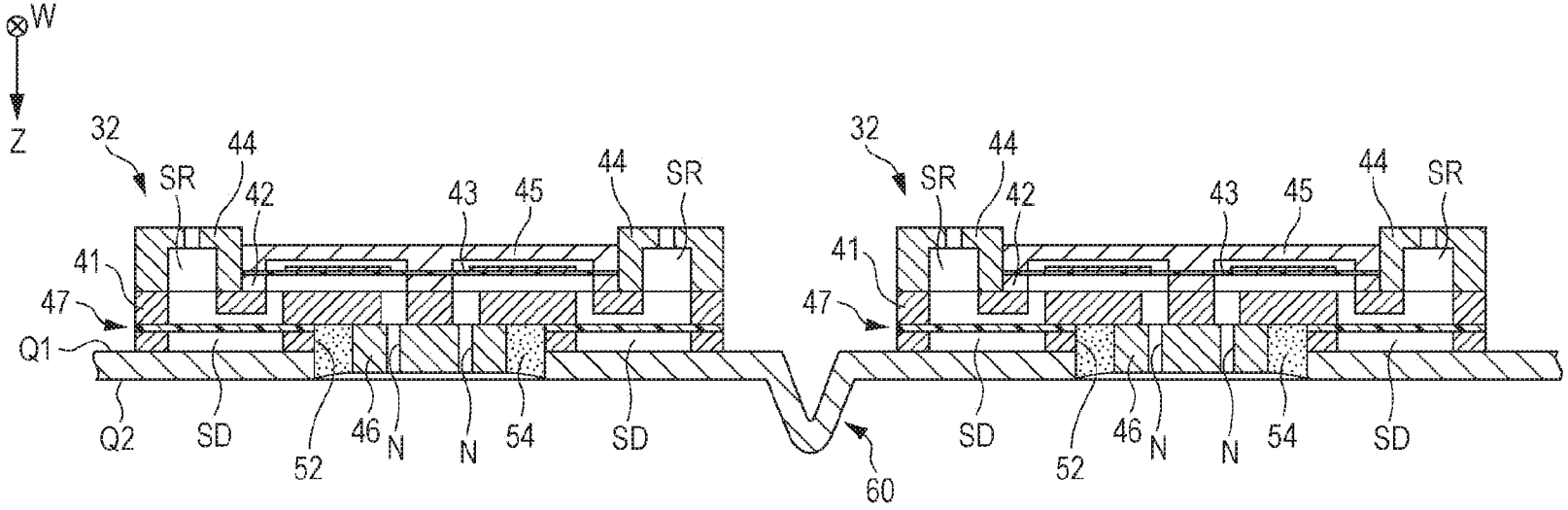
FIG. 7 is a view describing a case where the liquid ejection section is fixed to the fixing plate illustrated in FIG. 6 and is a cross-sectional view that is taken along line VII-VII of the fixing plate illustrated in FIG. 6.

FIG. 7 is a view describing a relationship between the fixing plate 38 (support section 382) and the liquid ejection section 32, and corresponds to a sectional view of VII-VII in FIG. 6. As illustrated in FIGS. 4 and 7, the plurality of liquid ejection sections 32 of the liquid ejecting head 30 is fixed to the first surface Q1 of the support section 382 of the fixing plate 38, for example, by adhesive such that the nozzle plate 46 exposes to the opening section 52 of the fixing plate 38. Then, as described above, in a state where the plurality of liquid ejection sections 32 are fixed to the first surface Q1 of the support section 382, each peripheral section 384 of the fixing plate 38 is fixed to the support body 34 illustrated in FIG. 4, for example, by adhesive. The plurality of liquid ejecting heads 30 having the structure illustrated above are arranged in the X-direction in a state where the second surface Q2 of the fixing plate 38 faces on the positive side in the Z-direction as illustrated in FIG. 3. As will be understood from the description above, the flat plate of the plurality of liquid ejecting heads 30 configured of the second surface Q2 corresponds to the liquid ejection surface.

As illustrated in FIGS. 6, 7, the opening section 52 exposing the nozzle plate 46 of the embodiment is formed in the support section 382 of the fixing plate 38 configuring a surface facing the medium 12. The plurality (six) of opening sections 52 corresponding to each liquid ejection section 32 are formed in the support section 382 and the opening sections 52 are respectively arranged in the X-direction at predetermined intervals to each other. Each opening section 52 is an elongated through-hole extending in the W-direction when viewed in a plan view (viewed in a direction perpendicular to the Z-direction). As illustrated in FIG. 3, in a state where the nozzle plate 46 of each liquid ejection section 32 is positioned on the inside of one opening section 52, each liquid ejection section 32 is fixed to the first surface Q1 of the support section 382. As will be understood from the description above, each opening section 52 of the fixing plate 38 is a through-hole for exposing the plurality of nozzles N of each liquid ejection section 32. As illustrated in FIG. 7, a space (specifically, an interval between an inner peripheral surface of the opening section 52 and an outer peripheral surface of the nozzle plate 46) on the inside of the opening section 52 is filled with a filling material 54 formed of, for example, a resin material. Thus, there is an advantage that a possibility of entering and staying of a large amount of ink in the space on the inside of the opening section 52 can be reduced compared to a configuration that does not form the filling material 54. On the other hand, in a configuration forming the filling material 54 with a hydrophilic resin material, there is a situation that the ink ejected from each nozzle Z is likely to adhere to a surface of the filling material 54.

As illustrated in FIG. 7, in the first embodiment, a surface of the support plate 474 of the compliance section 47 on a side opposite to the elastic film 472 is fixed to the first surface Q1 of the fixing plate 38, for example, by adhesive. That is, the opening section 476 of the support plate 474 is closed by the first surface Q1 of the fixing plate 38. A space interposed between the elastic film 472 and the first surface Q1 on the inside of the opening section 476 of the support plate 474 functions as the damper chamber SD for vibrating the elastic film 472.

As illustrated in FIGS. 6 and 7, the protrusion section 60 of the embodiment is formed in the support section 382 of the fixing plate 38 configuring the surface (ejection surface) facing the medium 12. One protrusion sections 60 is formed in the support section 382 and the protrusion section 60 protrudes from the second surface Q2 of the fixing plate 38 on the positive side (medium 12 side) in the Z-direction. As illustrated in FIG. 3, the protrusion section 60 of the first embodiment is formed in a region between the opening sections 52 which are adjacent to each other in the X-direction and extends along the W-direction similar to the opening section 52. Here, the protrusion section 60 is formed in an elongated shape (linear shape) of which a length (total length) in the W-direction is longer than a length of the opening section 52 in the W-direction. The length of the protrusion section 60 will be described below.

As will be understood from FIG. 6, the protrusion section 60 is not formed in a region between each peripheral section 384 (each edge of the support section 382) and the opening section 52 in the support section 382 of the fixing plate 38. Thus, it is possible to reduce a possibility of occurrence of an error in each position of the opening section 52 and the protrusion section 60 or on a positional relationship therebetween due to bending of the peripheral section 384. In addition, there is also an advantage that bending of the peripheral section 384 is easily performed compared to a configuration in which the protrusion section 60 is formed between the peripheral section 384 and the opening section 52.

As illustrated in FIG. 7, each liquid ejection section 32 is disposed in a position that does not overlap the protrusion section 60 when viewed in a plan view. Specifically, the support plate 474 bonded to the first surface Q1 of the fixing plate 38 in the liquid ejection section 32 does not overlap each protrusion section 60 on the second surface Q2 side. Furthermore, the damper chamber SD of the protrusion section 60 does not overlap the protrusion section 60 when viewed in a plan view. In a configuration in which the damper chamber SD of the protrusion section 60 overlaps the protrusion section 60 when viewed in a plan view, the damper chamber SD communicates with a space on the inside of the protrusion section 60 and errors may occur in characteristics (volume and pressure) of the damper chamber SD. In the embodiment, since the protrusion section 60 does not overlap the damper chamber SD when viewed in a plan view, it is possible to equalize the characteristics of each damper chamber SD.

Figure 8:
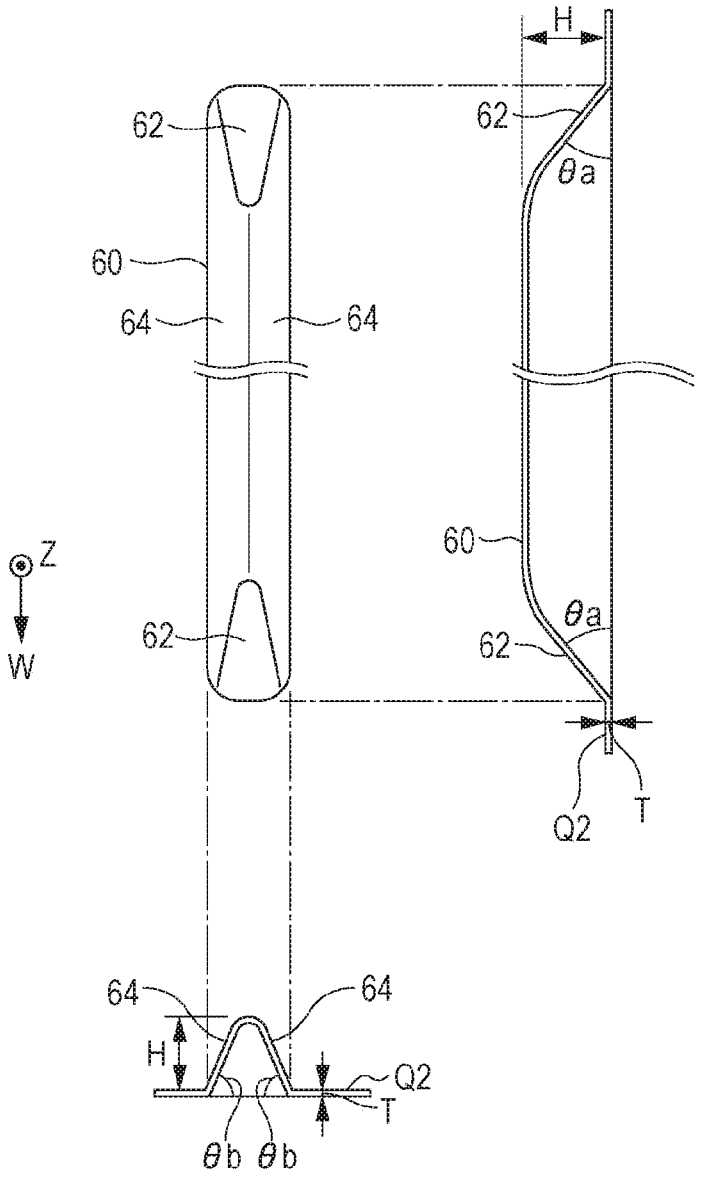
FIG. 8 is an enlarged view of a protrusion section illustrated in FIG. 7.

The protrusion section 60 of the first embodiment is integrally formed with the fixing plate 38. Specifically, the protrusion section 60 is formed by drawing with respect to the fixing plate 38. FIG. 8 is an enlarged view illustrating a specific example of a shape of arbitrary one protrusion section 60. As illustrated in FIG. 8, the protrusion section 60 is a three-dimensional structure including end surfaces 62 positioned on both end sides in the W-direction (that is, a longitudinal direction of the protrusion section 60) and side surfaces 64 positioned between the both ends. A top section crossing each side surface 64 in the protrusion section 60 is molded in a curved shape. In FIG. 8, a cross section parallel to the W-direction and a cross section perpendicular to the W-direction are illustrated together. As will be understood from each cross section, an angle θa of the end surface 62 of the protrusion section 60 with respect to the second surface Q2 is smaller than an angle θb of the side surface 64 of the protrusion section 60 with respect to the second surface Q2. That is, each end surface 62 of the protrusion section 60 is a gently inclined surface compared to the side surface 64.

As illustrated in FIG. 8, a height H of the protrusion section 60 with respect to the second surface Q2 is substantially constant in a segment other than the end surfaces 62 in a total length in the W-direction.

Specifically, the height H is maintained at a predetermined value through a segment of 90% or more of the total length of the protrusion section 60 in the W-direction. As illustrated in FIG. 8, the height H of the protrusion section 60 exceeds a plate thickness T of the fixing plate (support section 382) (H>T). Specifically, the plate thickness T of the fixing plate 38 is approximately 0.08 mm and the height H of the protrusion section 60 is approximately 0.4 mm to 0.6 mm. Furthermore, as described above, since the second surface Q2 of the fixing plate 38 is water-repellent processed, water-repellent property is also given to a surface (each end surface 62 and each side surface 64) of each protrusion section 60 formed on the second surface Q2. Thus, there is an advantage that a possibility of remaining of the ink on the surface of the protrusion section 60 can be reduced.

Furthermore, since the height H of the protrusion section 60 exceeds the plate thickness T of the fixing plate (support section 382) (H>T), for example, there is an advantage that it is possible to effectively reduce the contact of the medium 12 with the second surface Q2 of the fixing plate 38 compared to a configuration in which the height H of the protrusion section 60 is less than the plate thickness T of the fixing plate 38. In addition, an interval (volume of a space between both) between the inner peripheral surface of the opening section 52 and the outer peripheral surface of the nozzle plate 46 is reduced and it is possible to reduce adhesion of the ink to the surface of the filling material 54 with which the interval is filled.

Moreover, in a configuration in which an angle θa of the end surface 62 of the protrusion section 60 is steep (for example, close to a right angle), a leading end of the medium 12 engages a corner portion that is configured of the end surface 62 and the second surface Q2 and thereby it is possible to allow deformation such as wrinkles to occur in the medium 12. In the first embodiment, since an angle θa of the end surface 62 is regulated to be an angle that is smaller than the angle θb of the side surface 64, there is an advantage that it is possible to reduce a possibility (eventually, possibility of deformation of the medium 12) that the leading end of the medium 12 engages the end surface 62.

In the first embodiment, such a protrusion section 60 is formed so as to protrude from the second surface Q2 of the fixing plate 38 on the positive side (medium 12 side) in the Z-direction. Thus, for example, as illustrated by the broken line in FIG. 2, when the medium 12 is deformed (for example, curled) on the liquid ejecting unit 26 side between the first rollers 242 and the second rollers 244, it becomes possible that the medium 12 does not reach the second surface Q2 of the fixing plate 38 by the contact of the medium 12 with the protrusion section 60.

Furthermore, the fixing plate 38 of the first embodiment is fixed to the nozzle plate 46 through members (specifically, the flow path substrate 41 and the compliance section 47) other than the nozzle plate 46. That is, both the fixing plate 38 and the nozzle plate 46 are disposed on one side (positive side in the Z-direction) of the flow path substrate 41. Thus, for example, it is possible to reduce the interval between the medium 12 and the nozzle plate 46 compared to a configuration in which the fixing plate 38 is directly bonded to the surface of the nozzle plate 46. Therefore, there is also an advantage that it is possible to effectively reduce the error of the landing position of the ink on the surface of the medium 12. Furthermore, since the plurality of liquid ejection sections 32 are fixed to the common fixing plate 38, for example, there is an advantage that it is possible to adjust a positional relationship between the liquid ejection sections 32 with high precision compared to a configuration in which each liquid ejection section 32 is fixed to an individual member.

Relationship Between Protrusion Section and Abutting Region of Sealing Body

Meanwhile, the printing apparatus 10 of the first embodiment includes a sealing mechanism (capping mechanism)

for sealing (closing) the nozzle N if necessary when performing a maintenance operation (for example, nozzle cleaning) of the nozzle N and the like. The sealing mechanism includes a cap-shaped sealing body and seals the opening section 52 exposing the nozzle N so as to surround the opening section 52 by allowing the sealing body to come into contact with the second surface (ejection surface) Q2 of the fixing plate 38. Furthermore, since the sealing body maintains humidity so as not to evaporate moisture of the ink, the ink easily adheres to the sealing body. Thus, if the sealing body to which the ink adheres abuts the second surface Q2 of the fixing plate 38, the ink is transferred and adheres to a region (hereinafter, referred to as "abutting region") where the sealing body abuts in the second surface Q2. As described above, the ink adhered to the second surface Q2 of the fixing plate 38 can be removed by wiping with a blade (not illustrated) and the like. However, all the ink cannot be removed even after wiping and the ink may remain on the second surface Q2. In order to effectively reduce adhering of the ink remaining the abutting region of the second surface Q2 of the fixing plate 38 to the medium 12, the length (total length) and the arrangement position of the protrusion section 60 according to the embodiment are determined taking into account the abutting region.

Figure 9:
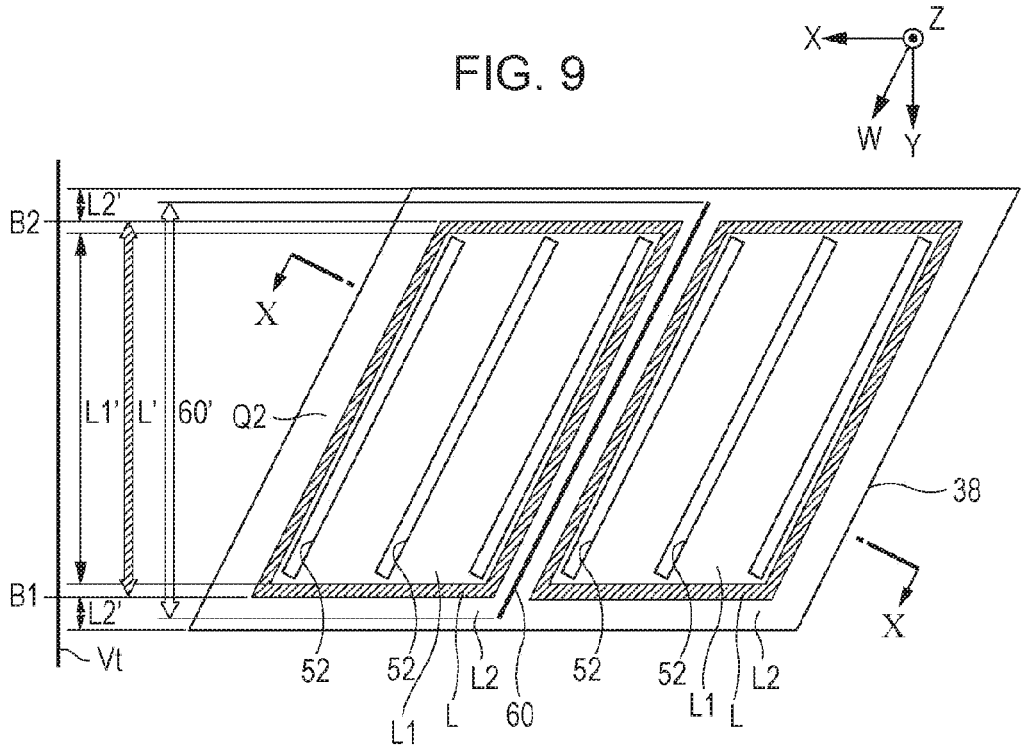
FIG. 9 is a view describing a relationship between the protrusion section and the abutting region according to the first embodiment and is a plan view of the ejection surface illustrated in FIG. 6.
Figure 10:
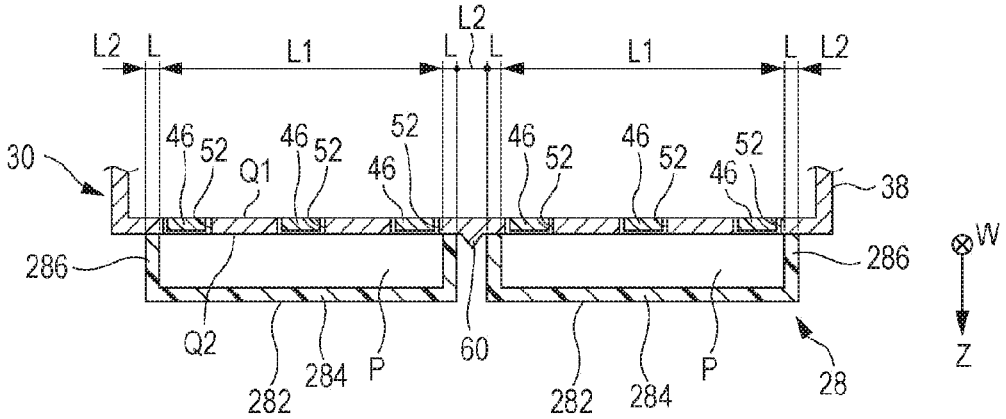
FIG. 10 is a view describing a case where two sealing bodies come into contact with one fixing plate and is a sectional view that is taken along line X-X of the fixing plate illustrated in FIG. 9.

Hereinafter, specifically, a relationship between the protrusion section 60 and the abutting region will be described. FIG. 9 is a view describing a relationship between the protrusion section 60 and an abutting region L of the sealing mechanism 28 of the embodiment, and is a plan view of the second surface Q2 of the fixing plate 38. FIG. 10 is a view describing a case where a sealing body 282 of the sealing mechanism 28 comes into contact with the fixing plate 38 and is a sectional view that is taken along line X-X indicated in FIG. 9. The sealing mechanism 28 illustrated in FIG. 10 includes two cap-shaped sealing bodies 282. Each sealing body 282 abuts the abutting region L of the second surface Q2 of the fixing plate 38 and seals the opening sections 52 exposing the nozzle N by surrounding the opening sections 52 by three at a time.

As illustrated in FIG. 9, each sealing body 282 is an elastic body that is formed such that a base section 284 and a sealing section 286 have an integral cap-shape, and is formed, for example, by injection molding of a resin material. The base section 284 is a rectangular flat plate-shaped portion configuring a bottom portion of the cap and the sealing section 286 is a rectangular frame-shaped portion configuring a side portion of the cap. The sealing section 286 forms an opening on a side opposite to the base section 284 by circularly protruding from a periphery of the base section 284 and forms a inner space P to be sealed hollow space on an inside thereof.

According to such a sealing mechanism 28, an end surface (top surface on the side opposite to the base section 284) of the sealing section 286 abuts the abutting region L of the second surface Q2 of the fixing plate 38 so as to surround each nozzle N by the sealing section 286. Thus, it is possible to close the nozzles N in a state where each nozzle N faces the inner space P. As described above, the abutting region L is a region where the sealing body 282 abuts and is a boundary region dividing into an inner region L1 and an outer region L2 inside thereof in the second surface Q2 of the fixing plate 38. The inner region (inner region of an inner periphery of the abutting region L) L1 of the abutting region L is a region that is sealed by the sealing body 282 and the outer region (outer region of an outer periphery of the abutting region L) L2 of the abutting region L is a region that is not sealed by the sealing body 282.

The length (the total length) and the arrangement position of the protrusion section 60 of the embodiment are determined by a relationship with such an abutting region L. Specifically, as illustrated in FIG. 9, when projecting the abutting region L and the protrusion section 60 along the first direction (X-direction) on a virtual line Vt along the second direction (Y-direction) that is the lateral direction orthogonal to the first direction that is the longitudinal direction of the second surface Q2, a projection 60' of the protrusion section 60 is disposed so as to cross boundaries B1 and B2 of a projection L' of the abutting region L. Here, in the embodiment, since the transport direction matches the second direction (Y-direction), the virtual line Vt is also along the transport direction. Here, the abutting region L is a rectangular shape and the projection L' of the abutting region L is a straight line. Both end portions of the straight line of the projection L' of the abutting region L correspond to projection of a part of the outer periphery of the abutting region L. One end of the straight line of the projection L' of the abutting region L is the boundary B1 and the other end is the boundary B2. Moreover, the outside of the boundaries B1 and B2 is a projection L2' of the outer region L2.

A range (range of the boundaries B1 to B2) in which the straight line of such a projection L' is a range of the abutting region L and is a range to which the ink may adhere. Thus, in the embodiment, as illustrated in FIG. 9, the length (total length) of the protrusion section 60 in the W-direction is a length exceeding the range of the boundaries B1 to B2 of the projection L' of the abutting region L and thereby one protrusion section 60 is disposed so as to cross both the boundaries B1 and B2 of the projection L'. Thus, since a range of the projection 60' of the protrusion section 60 in the Y-direction includes a range of the projection L' of the abutting region L in the Y-direction, even if the medium 12 that is transported in the Y-direction is curled and then approaches the fixing plate 38 of the liquid ejecting head 30, it is possible that the medium 12 does not come into contact with an entirety of the abutting region L. Thus, it is possible to effectively reduce adhering of the ink adhered to the abutting region L to the medium 12.

Furthermore, since the protrusion section 60 illustrated in FIG. 9 is formed between the abutting regions L adjacent to each other in the X-direction, it is possible to effectively reduce adhering of the ink remaining in the abutting region L to the medium 12 by one protrusion section 60 while maintaining the sealing performance between each sealing body 282 and the second surface Q2 of the fixing plate 38. Furthermore, as illustrated in FIG. 10, since the protrusion section 60 of the first embodiment is disposed between the plurality of opening sections 52, the protrusion section 60 also has a function of reducing adhering of the ink remaining within the opening section 52 to the medium 12. In this regard, it can be understood that the range of the projection 60' of the protrusion section 60 in the Y-direction illustrated in FIG. 9 includes the range the projection L' of the abutting region L including the opening section 52 in the Y-direction.

Comparative Example of First Embodiment

Figure 11:
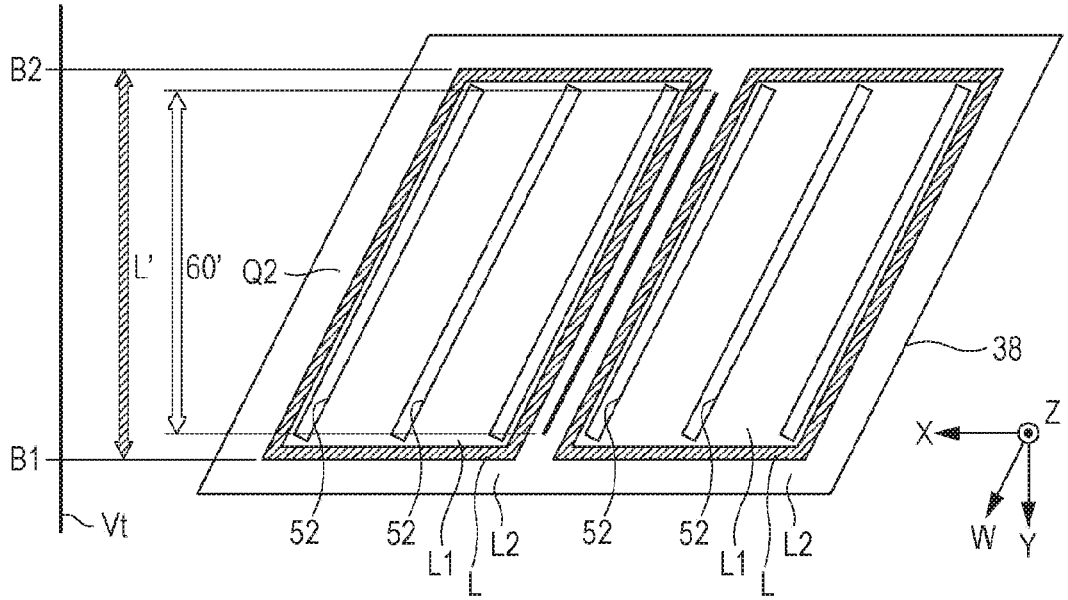
FIG. 11 is a plan view describing a configuration of a protrusion section according to a comparative example of the first embodiment.

Here, a case where the protrusion section 60, of which the length (total length) in the W-direction is short to an extent that the projection 60' of the protrusion section 60 does not cross the boundaries B1 and B2 of the projection L' of the abutting region L in the virtual line Vt, is disposed will be described in detail as a comparative example of the first embodiment. FIG. 11 is a plan view describing a configuration of a protrusion section 60 according to a comparative example. A total length of the protrusion section 60 of FIG. 11 is short to an extent that a projection 60' of the protrusion section 60 is included within a range of a projection L' of an abutting region L. Thus, the projection 60' of the protrusion section 60 does not cross boundaries B1 and B2 the projection L' of the abutting region L. In such a comparative example, since length of the protrusion section 60 does not reach the boundary B1 and the boundary B2 of the projection L' of the abutting region L, if the medium 12 transported in the Y-direction is curled and then approaches the fixing plate 38 of the liquid ejecting head 30, when the medium 12 approaches one of the boundary B1 and the boundary B2, the medium 12 is out of the protrusion section 60. Thus, the medium 12 may come into contact with the abutting region L. In this case, if the ink remains in the abutting region L, the ink may adhere to the medium 12.

In this regard, since the length (total length) of the protrusion section 60 of the first embodiment is long to an extent that the range of the projection 60' includes the projection L' of the abutting region L and extends to cross the boundaries B1 and B2, even if the curled medium 12 approaches the vicinity of the abutting region L, the medium 12 comes into contact with a portion of the protrusion section 60 which extends to cross the boundary B1 and the boundary B2 of the projection L' of the abutting region L. Thus, the medium 12 passes through the fixing plate 38 without coming into contact with the abutting region L. Therefore, it is possible to greatly reduce the possibility of adhering of the ink adhering to the abutting region L to the medium 12.

Modification Example of Protrusion Section According to First Embodiment

Figure 12:
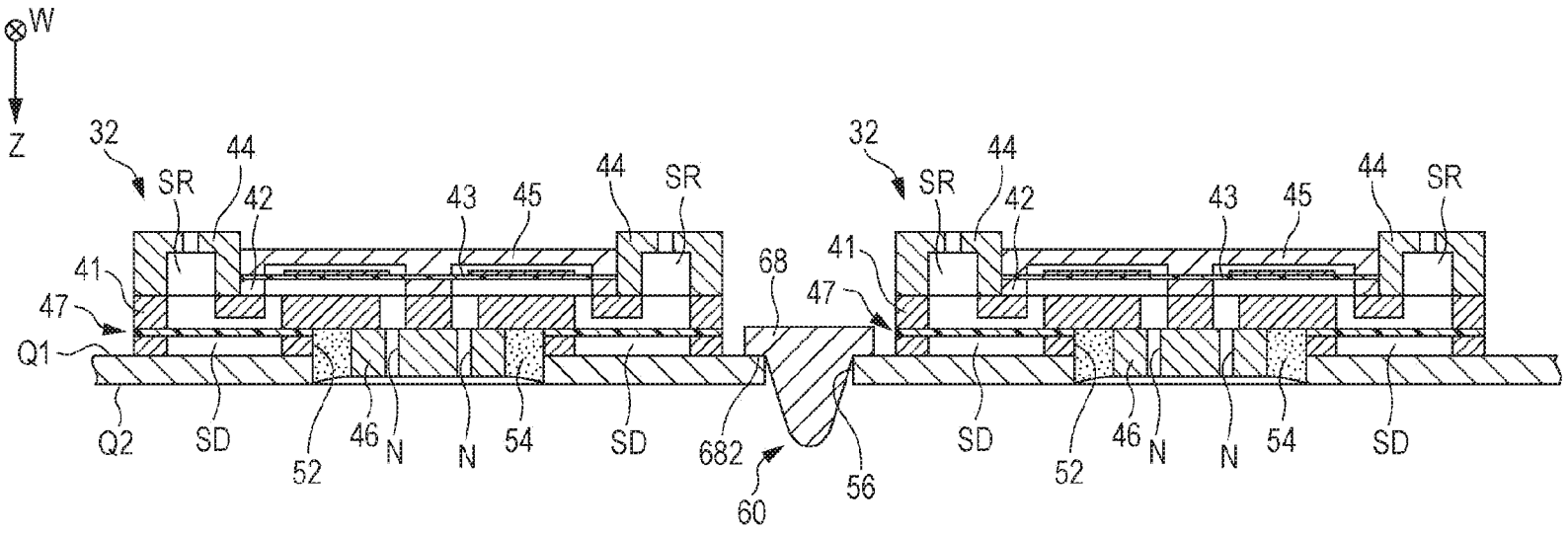
FIG. 12 is a sectional view describing a modification example of a protrusion section according to the first embodiment.
Figure 13:
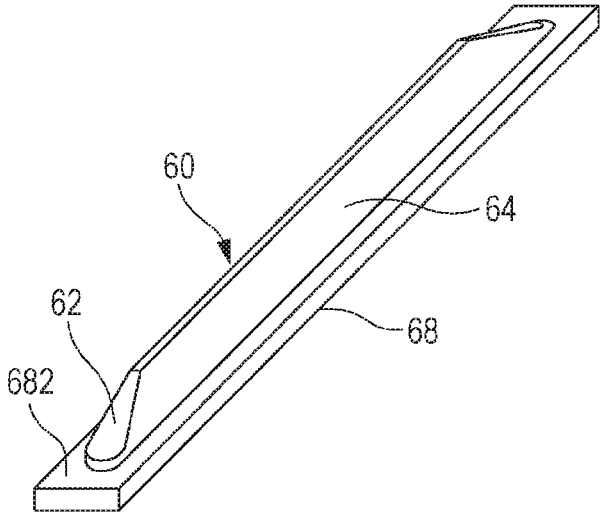
FIG. 13 is an external perspective view illustrating a configuration of the protrusion section illustrated in FIG. 12.

Next, a modification example of the protrusion section 60 according to the first embodiment will be described with reference to FIGS. 12 and 13. The protrusion section 60 of FIG. 7 described above is described as a case of being integrally configured with the fixing plate 38. Here, a case where a protrusion section 60 is configured to be separated from a fixing plate 38 is described as an example. FIG. 12 is a view describing the modification example of the protrusion section 60 according to the first embodiment, is a sectional view of a case where the protrusion section 60 is configured to be separated from the fixing plate 38, and corresponds to FIG. 7. FIG. 13 is an external perspective view illustrating a configuration of the protrusion section 60 illustrated in FIG. 12. Moreover, in FIGS. 12 and 13, upper and lower portions of the protrusion section 60 are inverted. The protrusion section 60 illustrated in FIGS. 12 and 13 are integrally formed with an elongated connection section 68, for example, by injection molding of a resin material and protrudes from a surface 682 of the connection section 68. A shape of the protrusion section 60 similar to that of the protrusion section 60 illustrated in FIG. 9.

On the other hand, a through-hole 56 extending in the W-direction is formed for each protrusion section 60 in the fixing plate 38 illustrated in FIG. 12. A lateral width of the through-hole 56 has a dimension exceeds a lateral width of the protrusion section 60 and is less than a lateral width of the connection section 68. The connection section 68 is fixed to a first surface Q1 of the fixing plate 38. Specifically, the surface 682 of the connection section 68 in which the protrusion section 60 is formed is fixed to the first surface Q1, for example, by adhesive such that the connection section 68 does not overlap the liquid ejection section 32 when viewed in a plan view. In a state where the surface 682 of the connection section 68 is fixed to the first surface Q1, the protrusion section 60 protrudes on the second surface Q2 side through the through-hole 56.

As described above, since a portion of the protrusion section 60 illustrated in FIG. 12 protruding from the second surface Q2 of the fixing plate 38 has the same shape as that of the protrusion section 60 illustrated in FIG. 9, it is possible to achieve the same effects as those of the protrusion section 60 illustrated in FIG. 9. Moreover, in the protrusion section 60 of FIG. 9 that is formed by drawing with respect to the fixing plate 38, the fixing plate 38 may be deformed due to stress generated when forming the protrusion section 60, but since the protrusion section 60 illustrated in FIG. 12 is configured to be separated from the fixing plate 38 and is fixed (thus, drawing of the fixing plate 38 is not required) to the fixing plate 38, there is an advantage that flatness of the fixing plate 38 is likely to be maintained and manufacturing of the fixing plate 38 having high flatness is facilitated compared to the protrusion section 60 illustrated in FIG. 9. On the other hand, since the protrusion section 60 illustrated in FIG. 9 is integrally formed with the fixing plate 38, reduction of the number of components of the liquid ejecting head 30 and simplification (omission of process of adhering the separated protrusion section 60 to the fixing plate 38) of a manufacturing process are realized.

Figure 14:
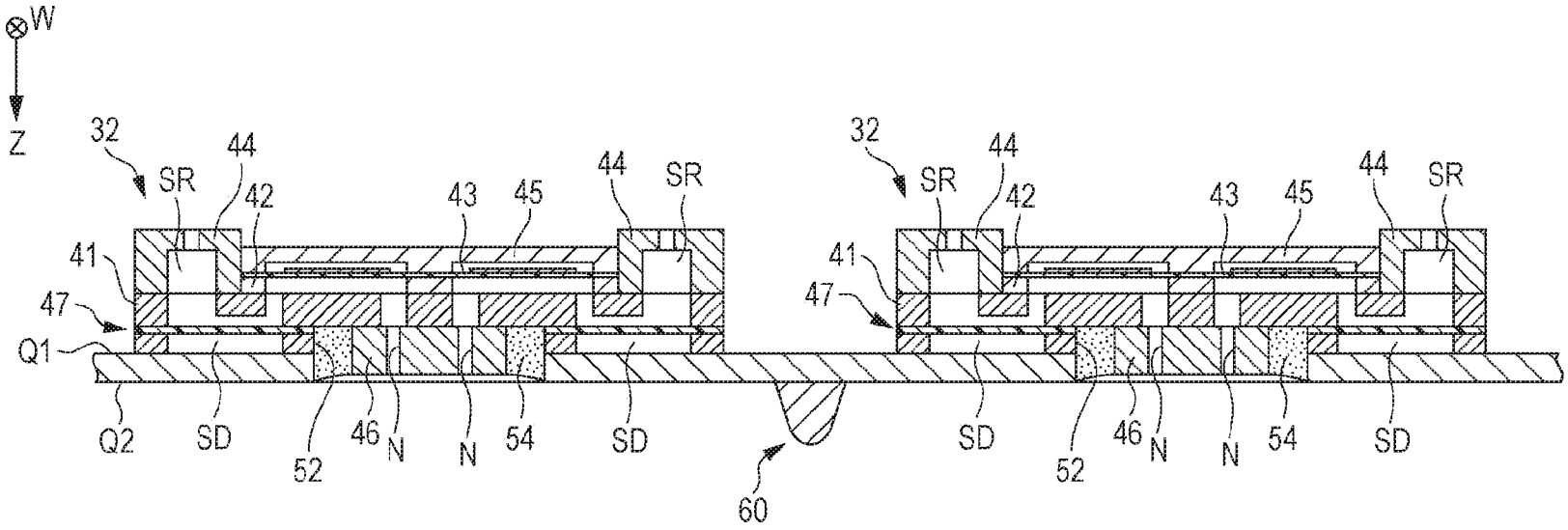
FIG. 14 is a sectional view describing a configuration of another modification example of a protrusion section according to the first embodiment.

Another Modification Example of Protrusion Section According to First Embodiment Next, another modification example of the protrusion section 60 according to the first embodiment will be described with reference to FIG. 14. In FIG. 12 described above, a case where the protrusion section 60 that is separately formed from the fixing plate 38 is connected to the first surface Q1 is described, but, here, a case where the protrusion section 60 separately formed from the fixing plate 38 is connected to the second surface Q2 is described as an example. FIG. 14 is a sectional view describing the other modification example of the protrusion section 60 according to the first embodiment. In the configuration of FIG. 14, the protrusion section 60 having the same shape as that of the protrusion section 60 illustrated in FIG. 9 is separately formed from the fixing plate 38 and the protrusion section 60 is connected to the second surface Q2 of the fixing plate 38. Thus, the protrusion section 60 of FIG. 14 also can achieve the same effects as those of the protrusion section 60 illustrated in FIG. 9. Furthermore, since the protrusion section 60 of FIG. 14 is directly connected to the second surface Q2 of the fixing plate 38, it is possible to sufficiently ensure an area for adhering the protrusion section 60. Thus, there is an advantage that a mechanical strength thereof is further easily ensured than the protrusion section 60 of FIG. 12 (it is possible to prevent the protrusion section 60 from falling off due to collision of the medium 12). On the other hand, according to the configuration of FIG. 12, since the connection section 68 in which the protrusion section 60 is disposed is connected to the first surface Q1 of the fixing plate 38, there is an advantage that adhesive used for installation of the protrusion section 60 is unlikely to protrude on the surface of the second surface Q2 (and thus, it is possible to reduce a possibility that the nozzle N is closed by adhesion of adhesive) compared to the configuration of FIG. 14.

Modification Example of Fixing Plate According to First Embodiment

Figure 15:
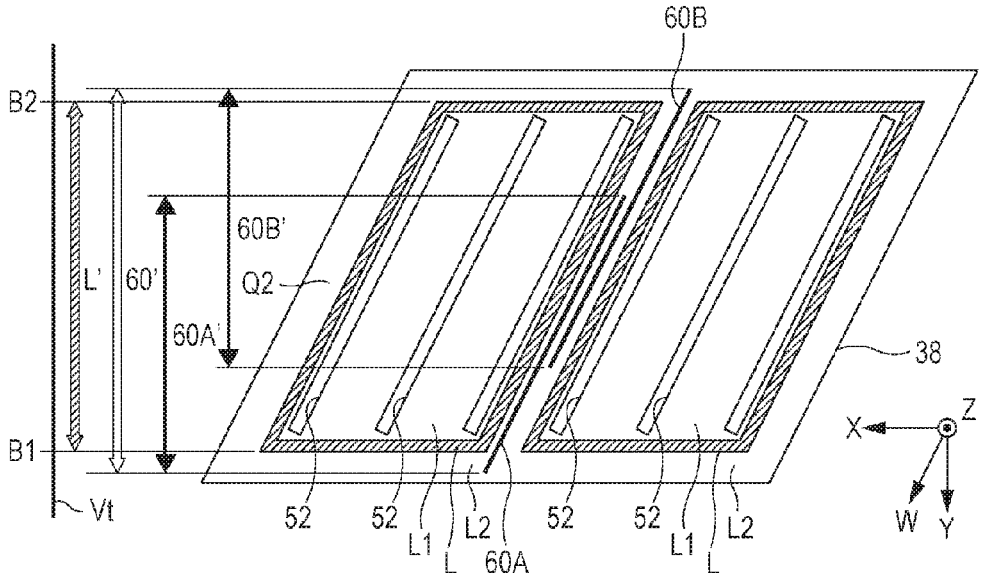
FIG. 15 is a plan view describing a modification example of a fixing plate according to the first embodiment.

Next, a modification example of the fixing plate 38 of the first embodiment will be described with reference to FIG. 15. FIG. 15 is a plan view describing the modification example of the fixing plate 38 according to the first embodiment. Also in FIG. 15, the same virtual line Vt as that of FIG. 9 is assumed. The fixing plate 38 illustrated in FIG. 9 is described as a case where one protrusion section is disposed for every fixing plate 38 of each liquid ejecting head 30 is described, but the fixing plate 38 is not limited to the example, and for example, as illustrated in FIG. 15, a plurality of the protrusion sections may be disposed for every the fixing plate 38 of each liquid ejecting head 30. FIG. 15 illustrates a case where two protrusion sections 60A and 60B are disposed in one fixing plate 38. Each of the protrusion sections 60A and 60B is disposed between the abutting regions L adjacent to each other in the X-direction. Each of the protrusion sections 60A and 60B is disposed so as to overlap in the X-direction to be shifted each other in the W-direction. The protrusion section 60A is disposed such that a projection 60A' of the protrusion section 60A in the virtual line Vt crosses the boundary B1 of the projection L' of the abutting region L and the protrusion section 60B is disposed such that a projection 60B' thereof crosses the boundary B2 of the projection L' of the abutting region L.

As described above, the projections 60A' and 60B' of the protrusion sections 60A and 60B overlap and become the continuous projection 60' by disposing each of the protrusion sections 60A and 60B. Furthermore, the continuous projection 60' is a straight line crossing the boundaries B1 and B2 of the projection L' of the abutting region L. Moreover, in each of the protrusion sections 60A and 60B, if the projections 60A' and 60B' thereof are entirely continuous projection 60', the projections 60A' and 60B' of the protrusion sections 60A and 60B may not necessarily overlap.

Thus, even if the medium 12 that is transported in the Y-direction is curled, since the medium 12 comes into contact with any one of the protrusion sections 60A and 60B protruding from the fixing plate 38 on the liquid ejection side, it is possible that the medium 12 does not come into contact with a wide range of the second surface (ejection surface) Q2 of the fixing plate 38 also including the abutting region L. Similar to the protrusion section 60 illustrated in FIG. 9, it is possible to effectively reduce adhering of the ink remaining in the abutting region L to the medium 12. In this case, the number of the protrusion sections is not limited to two and may be three or more. Also in a case where the protrusion sections is three or more, each of the protrusion sections 60A and 60B is disposed such that the projection of each protrusion section becomes the entirely continuous projection and the continuous projection crosses the boundaries B1 and B2 of the projection L' of the abutting region L. Thus, it is possible to achieve the same effects as those of the protrusion section 60 illustrated in FIG. 9. Furthermore, it is possible to reduce the contact of the medium 12 with the second surface Q2 without increasing a distance between the second surface Q2 of the fixing plate 38 and the medium 12 by allowing heights of the protrusion sections 60A and 60B to be equal to each other from the second surface Q2 of the fixing plate 38.

Second Embodiment

Figure 16:
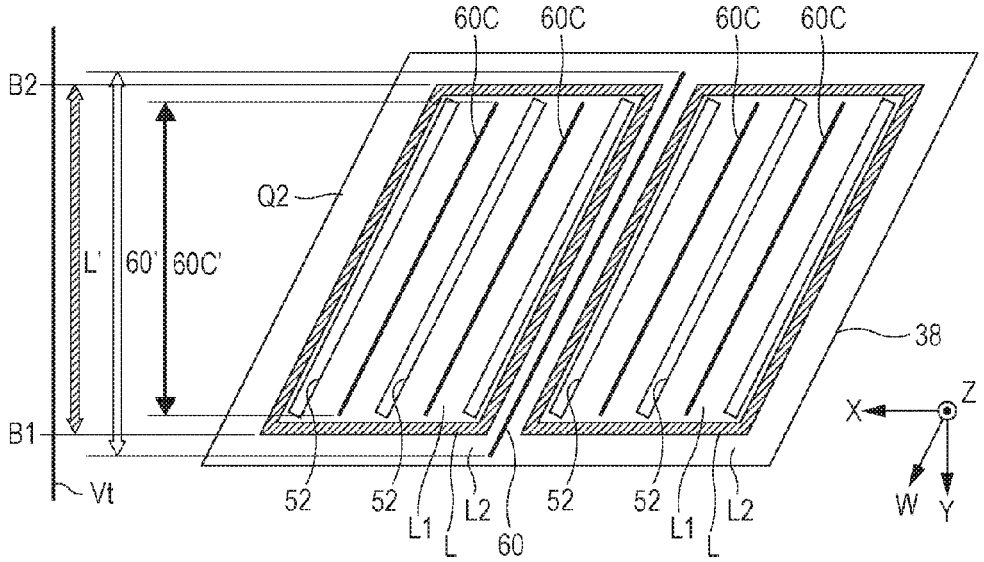
FIG. 16 is a plan view describing a configuration of a fixing plate of a liquid ejecting head according to a second embodiment of the invention.

A second embodiment of the invention will be described below. Moreover, in each aspect illustrated below, the same reference numerals that are used in the description of the first embodiment are given to elements having the same operations and functions as those in the first embodiment, and each of detailed descriptions will be appropriately omitted. FIG. 16 is a plan view describing a configuration of a fixing plate of a liquid ejecting head according to the second embodiment. Also in FIG. 16, a virtual line Vt similar to FIG. 9 is assumed. In the first embodiment described above, as illustrated in FIG. 9, a case where the protrusion section 60 is formed only between the adjacent abutting regions L of the fixing plate 38, that is, only in the outer region L2 of the abutting region L is described, but in the second embodiment, a case where a protrusion section 60C is also formed in an inner region L1 of the abutting region L in addition to the protrusion section 60 is exemplified.

In FIG. 16, the protrusion section 60 similar to FIG. 9 is formed between the abutting regions L of the fixing plate 38. In addition, the protrusion section 60 is disposed such that the projection 60' of the protrusion section 60 crosses boundaries B1 and B2 of a projection L' of the abutting region L in the virtual line Vt similar to 9. In FIG. 16, furthermore, the protrusion section 60C is also formed in an inner region L1 of the abutting region L of the fixing plate 38. The protrusion section 60C formed in the inner region L1 is disposed in a region between the opening sections 52 adjacent to each other in the X-direction and extends in the W-direction similar to the opening section 52. Here, the protrusion section 60C is formed in an elongated shape (linear shape) such that a length (total length) thereof in the W-direction is equal to a length of an opening section 52 in the W-direction.

As described above, the protrusion section 60 of FIG. 16 has the same shape as that of the protrusion section 60 illustrated in FIG. 9 and is formed between the abutting regions L similar to FIG. 9. Thus, it is possible that the medium 12 does not come into contact with the abutting region L. Thus, similar to the protrusion section 60 illustrated in FIG. 9, it is possible to effectively reduce adhering of ink remaining in the abutting region L to the medium 12. Furthermore, since the protrusion section 60C of FIG. 16 is disposed in the inner region (inner region of an inner periphery of the abutting region L) L1 of the abutting region L, it is possible to dispose the protrusion section 60C closer to the opening section 52 than an outer region L2 of the abutting region L. Thus, it is possible to enhance an effect of reducing the medium 12 comes into contact with the opening section 52 that is exposed by a nozzle plate 46. Thus, it is possible to effectively reduce adhering of ink remaining a surface of the vicinity (particularly, a filling material 54) of the opening section 52 or a surface of the nozzle plate 72 to the medium 12. Moreover, the number of the protrusion sections 60C disposed in the inner region L1 of the abutting region L is not limited to the case of FIG. 15.

Moreover, a possibility that the medium 12 comes into contact with the opening section 52 can be reduced as the protrusion section 60C formed in the inner region L1 of the abutting region L approaches the opening section 52 exposed by the nozzle plate 72. Thus, it is possible to further reduce the possibility of adhering of the ink remaining in the inside of the opening section 52 to the medium 12. In this regard, in the first embodiment, since the protrusion section 60C is directly formed in the fixing plate 38 in which such an opening section 52 is formed, it is possible to greatly reduce a distance between the opening section 52 of the fixing plate 38 and the protrusion section 60C compared to a configuration in which the protrusion section 60C is formed in an element separated from the fixing plate 38. Thus, the effect described above is particularly remarkable in reducing the possibility that the ink remaining in the inside of the opening section 52 adheres to the medium 12. Furthermore, as described above, since the distance between the opening section 52 of the fixing plate 38 and the protrusion section 60C is reduced, it is possible to reduce a height H of the protrusion section 60C necessary for reducing adhering of the ink remaining in the inside of the opening section 52 to the medium 12. Thus, since it is possible to further reduce a required interval (so-called platen gap) between the medium 12 and the fixing plate 38, as a result, there is an advantage that it is possible to reduce an error of a landing position of the ink on the surface of the medium 12. Furthermore, it is possible to reduce the contact of the medium 12 with the second surface Q2 without increasing a distance between the second surface Q2 of the fixing plate 38 and the medium 12 by allowing heights of the protrusion sections 60 and 60C to be equal to each other from the second surface Q2 of the fixing plate 38. Furthermore, as illustrated in FIG. 16, in the second embodiment, the longest protrusion section 60 of a plurality of the protrusion sections 60 and 60C is formed between insides of a plurality of opening sections 52 in the second surface Q2 of the fixing plate 38. Thus, since the protrusion section is bead processing, it is possible to effectively correct warpage of the fixing plate 38 generated by press processing by the effect of bead processing, when forming the opening section 52 for example. In this regard, the configuration is similar to other embodiments described below.

Modification Example of Fixing Plate According to Second Embodiment

Figure 17:
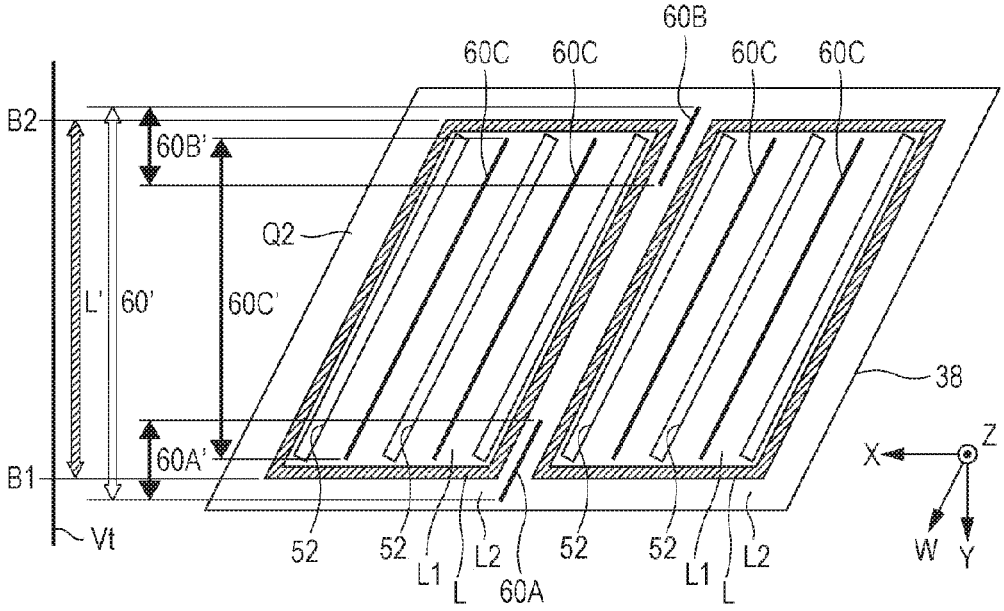
FIG. 17 is a plan view describing a modification example of a fixing plate according to the second embodiment.

Next, a modification example of the fixing plate 38 according to the second embodiment will be described with reference to FIG. 17. FIG. 17 is a plan view describing the modification example of the fixing plate 38 according to the second embodiment. Also in FIG. 17, a virtual line Vt similar to FIG. 16 is assumed. In FIG. 16 described above, a case where one protrusion section 60 disposed between the abutting regions L is disposed in each fixing plate 38 is described, but is not limited to the embodiment, and for example, as illustrated in FIG. 17, a plurality of protrusion sections 60 may be disposed in each fixing plate 38. FIG. 17 illustrates a case where two protrusion sections 60A and 60B are disposed in one fixing plate 38. As illustrated in FIG. 15 described above, the two protrusion sections 60A and 60B may be disposed to overlap in the W-direction, but as illustrated in FIG. 17, may be disposed to be separated in the W-direction. The protrusion section 60A of FIG. 17 is disposed such that a projection 60A' of the protrusion section 60A in the virtual line Vt crosses a boundary B1 of a projection L' of a abutting region L and a protrusion section 60B is disposed such that a projection 60B' of the protrusion section 60B in the virtual line Vt crosses a boundary B2 of the projection L' of the abutting region L.

As illustrated in FIG. 17, if the protrusion sections 60A and 60B are disposed to be separated, it is not continuous only by the projections 60A' and 60B' of the protrusion sections 60A and 60B. However, the projections 60A' and 60B' of the protrusion sections 60A and 60B, and the projection 60C' of each protrusion section 60C become an entirely continuous projection 60'. Each of the protrusion sections 60A, 60B, and 60C are disposed in the fixing plate 38 such that the continuous projection 60' crosses the boundaries B1 and B2 of the projection L' of the abutting region L. Thus, even if the medium 12 that is transported in the Y-direction is curled, since the medium 12 comes into contact with any one of the protrusion sections 60A, 60B, and 60C protruding from the fixing plate 38 on the liquid ejection side, it is possible to achieve the same effects as those of the case illustrated in FIG. 16. Furthermore, each of the protrusion sections 60A and 60B may be disposed in any way if the projections 60A' and 60B' thereof, and the projection 60C' of the protrusion section 60C become the entirely continuous projection 60', and the continuous projection 60' crosses the boundaries B1 and B2 of the projection L' of the abutting region L. Furthermore, it is possible to reduce the contact of the medium 12 with the second surface Q2 without increasing a distance between the second surface Q2 of the fixing plate 38 and the medium 12 by allowing heights of the protrusion sections 60A, 60B, and 60C to be equal to each other from the second surface (ejection surface) Q2 of the fixing plate 38. In this regard, the configuration is similar to other embodiments described below.

Third Embodiment

A third embodiment of the invention will be described below. In the first and second embodiments, a case where the sealing mechanism 28 of which the sealing bodies 282 abut the fixing plate 38 by two is provided is described, but in the third embodiment, a case where a sealing mechanism 28 of which sealing bodies 282 abut a fixing plate 38 by three is provided is exemplified.

Figure 18:
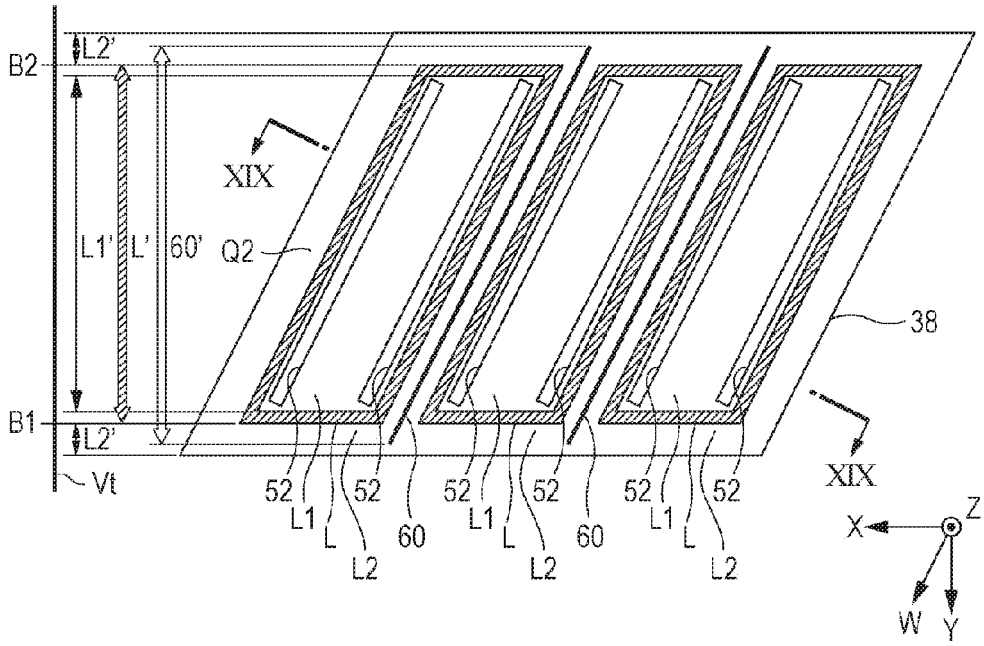
FIG. 18 is a plan view describing a configuration of a fixing plate of a liquid ejecting head according to a third embodiment of the invention.
Figure 19:
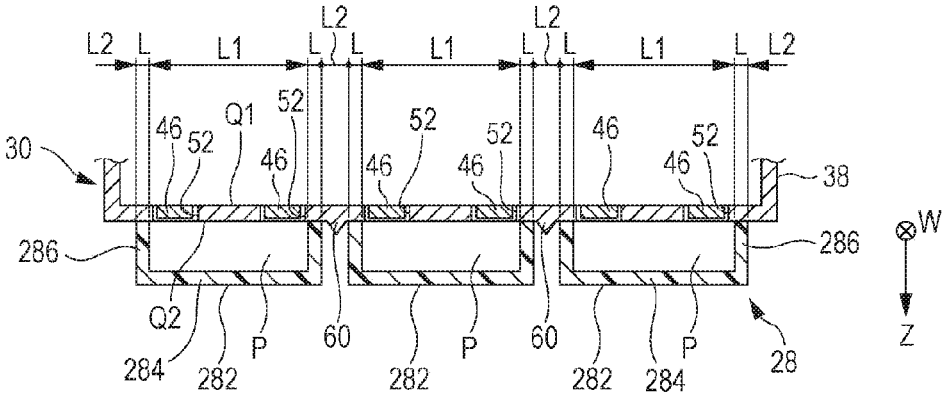
FIG. 19 is a view describing a case where three the sealing bodies come into contact with one the fixing plate and is a sectional view that is taken along line XIX-XIX of the fixing plate illustrated in FIG. 18.

FIGS. 18 and 19 are views describing a configuration of a fixing plate of a liquid ejecting head according to the third embodiment. FIG. 18 is a view describing a relationship between a protrusion section 60 and an abutting region L of the sealing mechanism 28 of the third embodiment and is a plan view of a second surface Q2 of the fixing plate 38. FIG. 19 is a view illustrating a case where the sealing bodies 282 of the sealing mechanism 28 come into contact with the fixing plate 38 and is a sectional view that is taken along line XIX-XIX indicated by FIG. 18. The sealing mechanism 28 illustrated in FIG. 19 includes three cap-shaped sealing bodies 282. Each sealing body 282 abuts an abutting region L of the second surface Q2 of the fixing plate 38 and seals the opening sections 52 exposing the nozzle N to surround two opening sections 52. Each sealing body 282 illustrated in FIG. 19 is an elastic body that is formed such that a base section 284 and a sealing section 286 are have an integral cap-shape. Each sealing body 282 illustrated in FIG. 19 has configurations similar to each sealing body 282 of FIG. 10 except that a width in the X-direction is narrower than each sealing body 282 of FIG. 10.

In the sealing mechanism 28 illustrated in FIG. 19, since three sealing bodies 282 are provided, as illustrated in FIG. 18, the number of abutting regions L of the second surface Q2 of the fixing plate 38 is also three. Thus, in the fixing plate 38 illustrated in FIG. 18, since regions between adjacent abutting regions L are two places, it is possible to form total two protrusion sections 60 one by one in each region. Similar to the protrusion section 60 illustrated in FIG. 9, each protrusion section 60 is disposed such that a projection 60' of the protrusion section 60 crosses both boundaries B1 and B2 of a projection L' of a abutting region L in a virtual line Vt.

According to the fixing plate 38 in the third embodiment illustrated as described above, it is also possible to increase the number of the protrusion sections 60 formed between the abutting regions L of each fixing plate 38 to be two by increasing the number of the sealing bodies 282 to be two. Thus, it is possible to effectively enhance an effect of reducing the contact of the medium 12 with the abutting region L while maintaining sealing performance between the second surface Q2 of the fixing plate 38 and each sealing body 282. Therefore, it is possible to further effectively reduce adhering of ink adhering to the abutting region L to the medium 12.

Moreover, the number of the sealing bodies 282 abutting one fixing plate 38 is not limited to two (first and second embodiments) or three (third embodiment) and may be four or more. In this case, since the number of the abutting regions L is increased as the number of the sealing bodies 282 is increased, it is also possible to increase the number of the protrusion sections 60 provided therebetween. Thus, it is possible to enhance the effect of reducing the contact of the medium 12 with the abutting region L. Therefore, it is possible to further effectively reduce adhering of the ink to the medium 12.

However, the sealing performance between the second surface Q2 of the fixing plate 38 and each sealing body 282 is ensured by pressing each sealing body 282 onto the second surface Q2 by a predetermined pressing force. Thus, a force which is received on the second surface Q2 from an entirety of each sealing body 282 is increased as the number of the sealing bodies 282 is increased. Thus, it is preferable that the number of the sealing bodies 282 and the number of the protrusion sections 60 are determined while considering the force which is received on the second surface Q2 from an entirety of each sealing body 282.

Furthermore, the number of the sealing bodies 282 may be one. If the number of the sealing bodies 282 is one, since the number of the abutting regions L is also one, it is possible to form the protrusion sections 60 one or both sides of the abutting region L in the X-direction. Also in this case, it is possible to reduce the contact of the medium 12 with the abutting region L by disposing the protrusion sections 60 such that the projection 60' of each protrusion section 60 crosses both boundaries B1 and B2 of a projection L' of an abutting region L in the virtual line Vt.

Modification Example of Fixing Plate According to Third Embodiment

Figure 20:
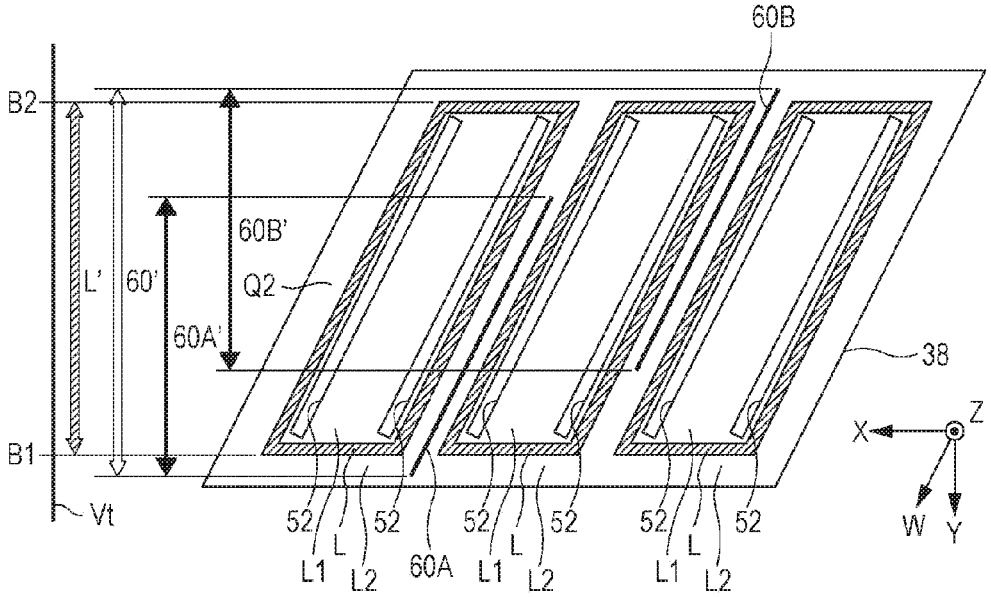
FIG. 20 is a sectional view describing a modification example of a fixing plate according to the third embodiment.

Next, a modification example of the fixing plate 38 of the third embodiment will be described with reference to FIG. 20. FIG. 20 is a plan view describing the modification example of the fixing plate 38 according to the third embodiment. Also in FIG. 20, a virtual line Vt similar to FIG. 18 is assumed. In FIG. 18 described above, a case where the protrusion sections 60 are formed in the regions between the abutting regions L of two places one by one in each region on the second surface Q2 of the fixing plate 38 and the protrusion section 60 is disposed such that the projection 60' of one protrusion section 60 crosses both the boundaries B1 and B2 of the projection L' of the abutting region L is exemplified. On the other hand, in FIG. 20, a case where lengths (total length) of the protrusion sections 60A and 60B which are respectively formed one by one in a region between two abutting regions L in the second surface Q2 of the fixing plate 38 are shortened, and the protrusion sections 60A and 60B are disposed by being shifted to each other in the W direction is exemplified. The protrusion section 60A is disposed such that the projection 60A' of the protrusion section 60A crosses the boundary B1 of the projection L' of the abutting region L in the virtual line Vt and the protrusion section 60B is disposed such that the projection 60B' thereof crosses the boundary B2 of the projection L' of the abutting region L.

As described above, the projections 60A' and 60B' of the protrusion sections 60A and 60B overlap and entirety of the projections becomes the continuous projection 60' by disposing each of the protrusion sections 60A and 60B. Furthermore, the continuous projection 60' is the straight line crossing the boundaries B1 and B2 of the projection L' of the abutting region L. Moreover, in each of the protrusion sections 60A and 60B, if the projections 60A' and 60B' thereof are entirely continuous projection 60', the projections 60A' and 60B' of the protrusion sections 60A and 60B may not necessarily overlap.

Thus, even if the medium 12 that is transported in the Y-direction is curled, since the medium 12 comes into contact with any one of the protrusion sections 60A and 60B protruding from the fixing plate 38 on the liquid ejection side, it becomes possible that the medium 12 does not come into contact with the abutting region L. Thus, similar to the protrusion section 60 illustrated in FIG. 18, it is possible to effectively reduce adhering of the ink remaining in the abutting region L to the medium 12. In this case, the number of the protrusion sections formed between the abutting regions L is not limited to one and may be two or more. Also in a case where the number of the protrusion sections formed between the abutting regions L is two or more, the projection of each protrusion section becomes the continuous projection and each protrusion section is disposed such that the continuous projection crosses the boundaries B1 and B2 of the projection L' of the abutting region L. Thus, it is possible to achieve the same effects as the case of the protrusion section 60 illustrated in FIG. 18.

Fourth Embodiment

Figure 21:
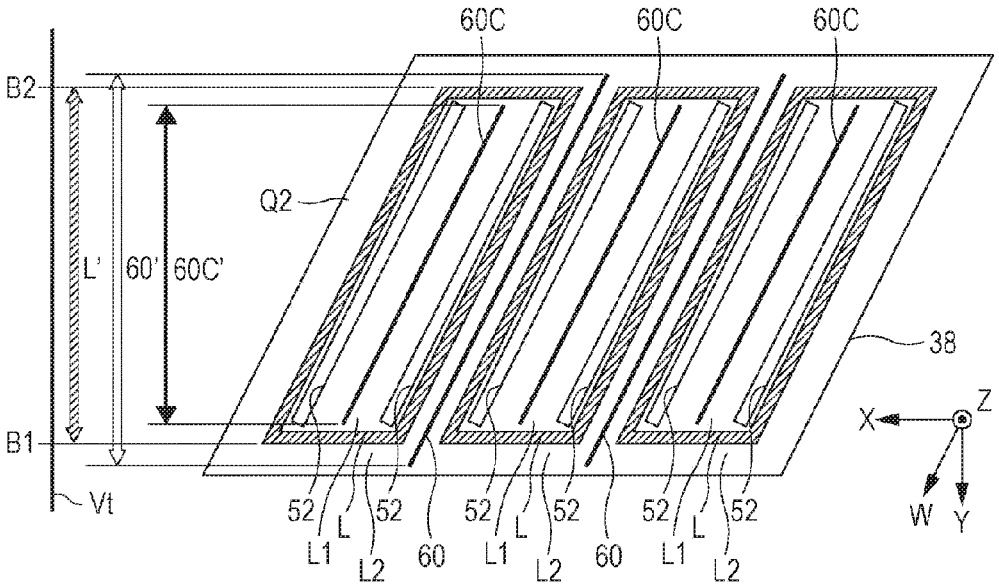
FIG. 21 is a sectional view describing a configuration of the fixing plate of a liquid ejecting head according to a fourth embodiment of the invention.

A fourth embodiment of the invention will be described below. FIG. 21 is a plan view describing a configuration of a fixing plate of a liquid ejecting head according to the fourth embodiment. Also in FIG. 21, a case of three abutting regions L is described similar to the third embodiment and a virtual line Vt similar to FIG. 18 is assumed. In the third embodiment described above, as illustrated in FIG. 18, a case where the protrusion section 60 is formed only between the adjacent the adjacent abutting regions L of the fixing plate 38, that is, only in the outer region L2 of the abutting region L is described, but in the fourth embodiment, a case where a protrusion section 60C is also formed in an inner region L1 of the abutting region L in addition to a protrusion section 60 is exemplified.

In FIG. 21, the protrusion sections 60 similar to those of FIG. 18 are respectively formed between the abutting regions L of two places of the fixing plate 38. Furthermore, similar to FIG. 18, each protrusion section 60 is disposed such that a projection 60' of the protrusion section 60 crosses boundaries B1 and B2 of a projection L' of a abutting region L in the virtual line Vt. Furthermore, in FIG. 16, the protrusion section 60C is also formed in the inner region L1 of the abutting region L of the fixing plate 38. The protrusion section 60C formed in the inner region L1 is disposed in the region between the opening sections 52 adjacent to each other in the X-direction and extends in the W-direction similar to the opening section 52. Here, the protrusion section 60C is formed in an elongated shape (linear shape) such that a length (total length) thereof in the W-direction is equal to a length of an opening section 52 in the W-direction.

As described above, the protrusion section 60 of FIG. 21 has the same shape as that of the protrusion section 60 illustrated in FIG. 18 and is formed between the abutting regions L similar to FIG. 18. Thus, it is possible that the medium 12 does not come into contact with the abutting region L. Therefore, similar to the protrusion section 60 illustrated in FIG. 18, it is possible to effectively reduce adhering of the ink remaining in the abutting region L to the medium 12. Furthermore, the protrusion section 60C of FIG. 21 is disposed in the inner region (inner region of an inner periphery of the abutting region L) L1 of the abutting region L, it is possible to dispose the protrusion section 60C closer to the opening section 52 than an outer region L2 of the abutting region L. Thus, it is possible to enhance an effect of reducing the contact of the medium 12 with the opening section 52 that is exposed by a nozzle plate 46. Thus, it is possible to effectively reduce adhering of ink remaining in the inside of the opening section 52 to the medium 12. Moreover, the number of the protrusion sections 60C disposed in the inner region L1 of the abutting region L is not limited to the case of FIG. 21.

Modification Example of Fixing Plate According to Fourth Embodiment

Figure 22:
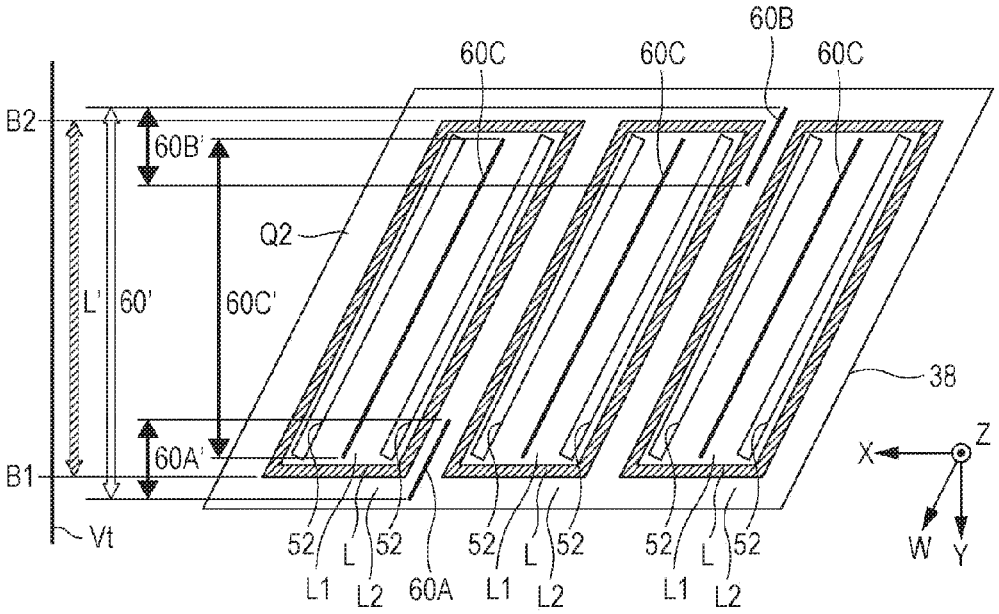
FIG. 22 is a sectional view describing a modification example of a fixing plate according to the fourth embodiment.

Next, a modification example of the fixing plate 38 of the fourth embodiment will be described with reference to FIG. 22. FIG. 22 is a plan view describing the modification example of the fixing plate 38 according to the fourth embodiment. Also in FIG. 22, a virtual line Vt similar to FIG. 21 is assumed. In FIG. 21 described above, a case where the protrusion sections 60 are formed in the regions between the abutting regions L of two places one by one in each region and the protrusion section 60 is disposed such that one protrusion section 60 crosses both the boundaries B1 and B2 of the projection L' is exemplified. On the other hand, in FIG. 22, lengths of protrusion sections 60A and 60B formed in a region between abutting regions L of two places one by one in each region is shortened, and the protrusion sections 60A and 60B are disposed to be shifted to each other in the W-direction. As illustrated in FIG. 20 described above, two protrusion sections 60A and 60B may be disposed to overlap in the W-direction or, as illustrated in FIG. 22, may be disposed to be separated from each other in the W-direction. Also in FIG. 22, the protrusion section 60A is disposed such that a projection 60A' of the protrusion section 60A crosses a boundary B1 of a projection L' of the abutting region L in the virtual line Vt and a protrusion sections 60B is disposed such that the projection 60B' of the protrusion section 60B crosses a boundary B2 of the projection L' of the abutting region L in the virtual line Vt.

As illustrated in FIG. 22, if the protrusion sections 60A and 60B are disposed to be separated, a continuous line cannot be formed only by the projections 60A' and 60B' of the protrusion sections 60A and 60B. However, the projections 60A' and 60B' of the protrusion sections 60A and 60B, and the projection 60C' of each protrusion section 60C become an entirely continuous projection 60'. Each of the protrusion sections 60A, 60B, and 60C are disposed in the fixing plate 38 such that the continuous projection 60' crosses the boundaries B1 and B2 of the projection L' of the abutting region L. Thus, even if the medium 12 that is transported in the Y-direction is curled, since the medium 12 comes into contact with any one of the protrusion sections 60A, 60B, and 60C protruding from the fixing plate 38 on the liquid ejection side, it is possible to achieve the same effects as those of the case illustrated in FIG. 21. Furthermore, each of the protrusion sections 60A and 60B may be disposed in any way if the projections 60A' and 60B' thereof, and the projection 60C' of the protrusion section 60C become the entirely continuous projection 60', and the continuous projection 60' crosses the boundaries B1 and B2 of the projection L' of the abutting region L.

Fifth Embodiment

A fifth embodiment of the invention will be described below. In the first to fourth embodiments, for the liquid ejecting head in which the fixing plate 38 for fixing the plurality of nozzle plates 46 is provided, a case where the second surface Q2 of the fixing plate 38 is exemplified as the ejection surface in which the plurality of nozzles N are distributed and the protrusion section 60 is formed in the fixing plate 38 is described. In the fifth embodiment, for a liquid ejecting head in which a fixing plate 38 is not provided, a case where a surface of a nozzle plate 72 on a nozzle ejection side is exemplified as an ejection surface in which a plurality of nozzles N are distributed and a case where the protrusion section 60 is formed in the nozzle plate 72 will be described.

Figure 23:
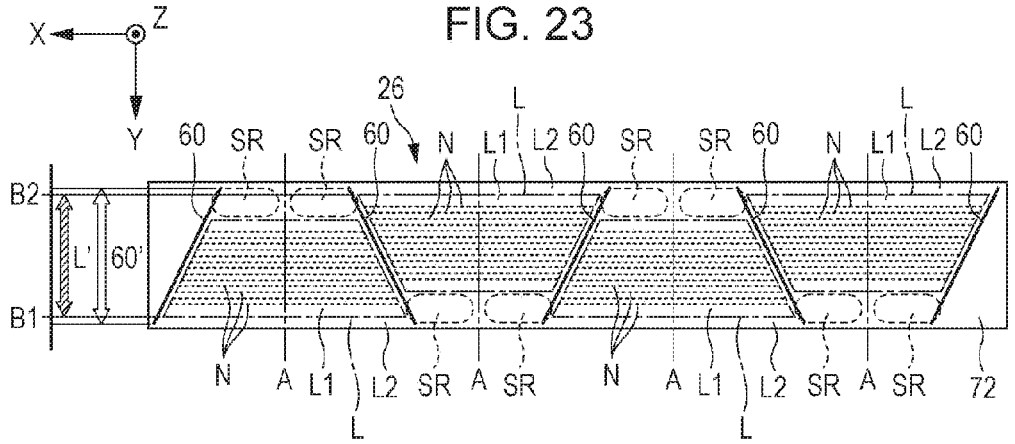
FIG. 23 is a plan view of an ejection surface of a liquid ejecting unit according to a fifth embodiment and a view describing a specific example of a case where protrusion sections are formed in the nozzle plate.

FIG. 23 is a plan view of the ejection surface facing a medium 12 in a liquid ejecting unit 26 of the fifth embodiment. As illustrated in FIG. 23, the liquid ejecting unit 26 of the fifth embodiment is a line head elongated in an X-direction including a nozzle plate 72 facing the medium 12. The nozzle plate 72 is a flat plate elongated in the X-direction over an entire width of the medium 12.

As illustrated in FIG. 23, a plurality of nozzle distribution regions are disposed in the nozzle plate 72 in the X-direction. Each nozzle distribution region is a region of a trapezoidal shape (specifically, isosceles trapezoid) in a plan view. A positional relationship between an upper base and a lower base of the trapezoidal shape is inverted between the nozzle distribution regions adjacent to each other in the X-direction. A plurality of nozzles N are formed in each nozzle distribution region in the X-direction and the Y-direction. A surface (surface facing the medium 12) positioned on a positive side in the Z-direction in the nozzle plate 72 illustrated in FIG. 23 functions as a liquid ejection surface in which the plurality of nozzles N are distributed.

The liquid ejecting unit 26 illustrated in FIG. 23 includes a plurality of storage chambers SR. Similar to the first embodiment, each storage chamber SR is a space storing ink ejected from the plurality of nozzles N. Specifically, the storage chamber SR is formed in a position corresponding to a top point of each nozzle distribution regions when viewed in a plan view (viewed from a direction perpendicular to the ejection surface). The ink distributed in a plurality of flow paths from the storage chamber SR is ejected from each nozzle N.

Each nozzle distribution region is surrounded by the abutting region L. Sealing bodies of the sealing mechanism (not illustrated) respectively abuts each abutting region L. As described above, the abutting region L is a region where the sealing body abuts and is a boundary region dividing the abutting region L into an inner region L1 and an outer region L2. The inner region (inner region of an inner periphery of the abutting region L) L1 of the abutting recording L is a region that is sealed by the sealing body and the outer region (outer region of an outer periphery of the abutting region L) L2 of the abutting region L is a region that is not sealed by the sealing body.

A plurality of protrusion sections 60 are formed in the ejection surface of the nozzle plate 72 of such a fifth embodiment to protrude on a liquid ejection side. A shape of each protrusion section 60 is the same as that of the protrusion section 60 of the first embodiment described above. Each protrusion section 60 is formed between the abutting regions L adjacent to each other in the X-direction. Here, since each abutting region L has the trapezoidal shape and abutting regions L are disposed to be inverted to each other. Thus, the protrusion sections 60 are respectively disposed to be inclined while inclinations are also inverted alternately to each other along an inclination of a side portion of the trapezoidal region. Specifically, the linear protrusion section 60 is formed within an interval of the nozzle distribution regions adjacent to each other in the X-direction along a direction of respective legs of the trapezoid. In the nozzle plate 72 of such a fifth embodiment, the protrusion sections 60 which are respectively adjacent to each other in the X-direction are in a relationship of a line symmetry with respect to an axis A orthogonal to the X-direction.

Each protrusion section 60 is disposed such that the projection 60' of each protrusion section 60 crosses the boundaries B1 and B2 of the projection L' of each abutting region L when the abutting region L and each protrusion section 60 is projected on the virtual line Vt in the second direction (Y-direction) orthogonal to the first direction (X-direction). Moreover, similar to the first embodiment, the direction (second direction) of the virtual line Vt is also not limited to the direction orthogonal to the first direction (X-direction) that is a longitudinal direction and, for example, may be an inclined direction as long as the direction intersects the first direction (X-direction).

In the fifth embodiment described above, similar to the first embodiment, each protrusion section 60 provided in the nozzle plate 72 is formed between the adjacent abutting regions L. Thus, even if the medium 12 that is transported in the Y-direction is curled, since the medium 12 comes into contact with each protrusion section 60 protruding on the liquid ejection side, it is possible that the medium 12 does not come into contact with each abutting region L. Thus, it is possible to achieve the same effects as those of the first embodiment. The protrusion sections 60 protruding from the ejection surface in which the plurality of nozzles N are disposed are disposed along a direction intersecting (orthogonal or inclined) the X-direction that is the longitudinal direction of the line had. Thus, there is also an advantage of reducing contact of the medium 12 with the ejection surface over a wide range in the Y-direction in which the medium 12 is transported compared to the configuration in which the protrusion section 60 is formed in the X-direction.

Modification Example of Nozzle Plate According to Fifth Embodiment

Figure 24:
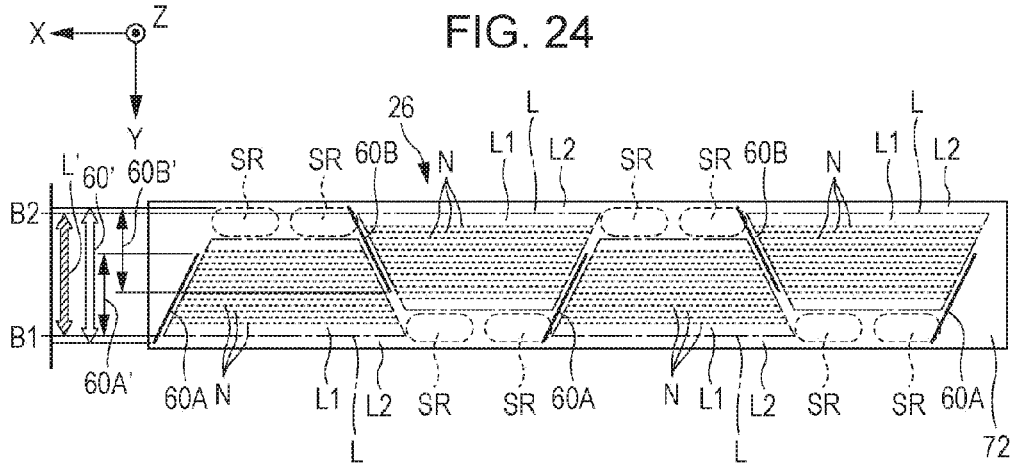
FIG. 24 is a plan view describing a modification example of an ejection surface according to the fifth embodiment.

Next, a modification example of the nozzle plate 72 according to the fifth embodiment will be described with reference to FIG. 24. FIG. 24 is a plan view describing the modification example of the nozzle plate 72 according to the fifth embodiment. Also in FIG. 24, a virtual line Vt similar to FIG. 23 is assumed. In FIG. 23, a case where the protrusion sections 60 are formed in the regions between the abutting regions L adjacent to each other on the ejection surface of the nozzle plate 72 one by one in each region and the protrusion section 60 is disposed such that the projection 60' of one protrusion section 60 crosses both the boundaries B1 and B2 of the projection L' of the abutting region L is exemplified. On the other hand, in FIG. 24, a case where the protrusion sections 60A and 60B of which lengths (total length) are respectively shortened are disposed alternately to be shifted to each other along a side portion of the abutting region L is exemplified. Each protrusion section 60A is disposed such that a projection 60A' of the protrusion section 60A crosses a boundary B1 of a projection L' of the abutting region L in the virtual line Vt and each protrusion sections 60B is disposed such that the projection 60B' thereof crosses a boundary B2 of the projection L' of the abutting region L.

As described above, the projections 60A' and 60B' of the protrusion sections 60A and 60B overlap and entirety of the projections becomes the continuous projection 60' by disposing each of the protrusion sections 60A and 60B. Furthermore, the continuous projection 60' is a straight line crossing the boundaries B1 and B2 of the projection L' of the abutting region L. Moreover, in each of the protrusion sections 60A and 60B, if the projections 60A' and 60B' are entirely continuous projection 60', the projections 60A' and 60B' of the protrusion sections 60A and 60B may not necessarily overlap. Thus, even if the medium 12 that is transported in the Y-direction is curled, since the medium 12 comes into contact with any one of the protrusion sections 60A and 60B protruding on the liquid ejection side, it is possible that the medium 12 does not come into contact with each abutting region L. Thus, it is possible to achieve the same effects as those of the first embodiment.

Sixth Embodiment

A sixth embodiment of the invention will be described below. Here, for a liquid ejecting head without a fixing plate 38, another specific example in which a surface on a nozzle ejection side of a nozzle plate 72 is exemplified as an ejection surface in which a plurality of nozzles N are distributed and protrusion sections 60 (60A, 60B, and 60C) are formed in the nozzle plate 72 is described.

Figure 25:
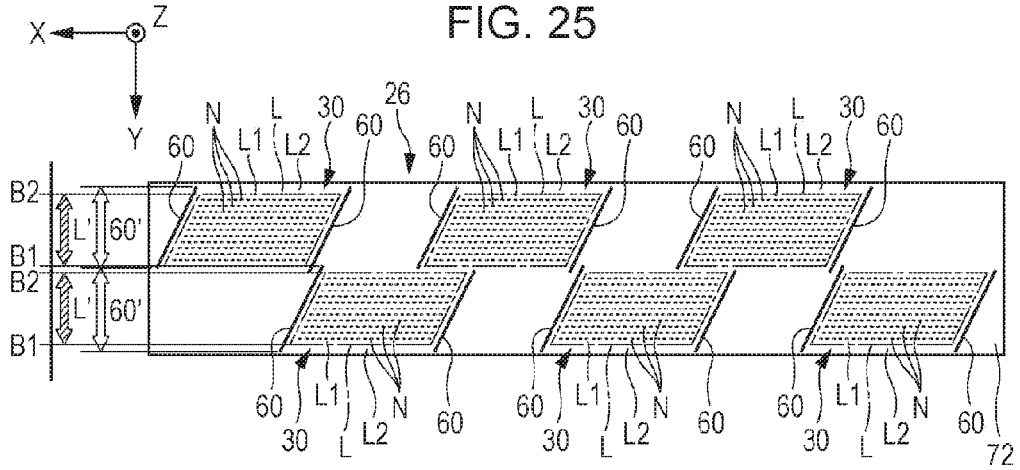
FIG. 25 is a plan view of an ejection surface of a liquid ejecting unit according to a sixth embodiment.

FIG. 25 is a plan view of the ejection surface facing a medium 12 in a liquid ejecting unit 26 of the sixth embodiment. As illustrated in FIG. 25, the liquid ejecting unit 26 of the sixth embodiment includes a plurality of liquid ejecting heads 30 which are arranged zigzag (so-called staggered arrangement) in an X-direction. Each of the plurality of liquid ejecting heads 30 includes a nozzle plate where the plurality of nozzles N are formed within an X-Y plane.

Each nozzle plate is surrounded by an abutting region L. Sealing bodies of a sealing mechanism (not illustrated) respectively abut each abutting region L. As described above, the abutting region L is an region abutting the sealing body and is a boundary region dividing the abutting region L into an inner region L1 and an outer region L2. The inner region (inner region of an inner periphery of the abutting region L) L1 of the abutting region L is a region that is sealed by the sealing body and the outer region (outer region of an outer periphery of the abutting region L) L2 of the abutting region L is a region that is not sealed by the sealing body.

A plurality of protrusion sections 60 are formed in the ejection surface of the nozzle plate 72 of such a sixth embodiment to protrude on a liquid ejection side. A shape of each protrusion section 60 is the same as that of the protrusion section 60 of the first embodiment described above. Each protrusion section 60 is formed between the abutting regions L adjacent to each other in the X-direction. Here, since the abutting regions L are arranged in a grid shape, the protrusion sections 60 are disposed on both sides of each abutting region L in the X-direction.

Each protrusion section 60 is disposed such that the projection 60' of each protrusion section 60 crosses the boundaries B1 and B2 of the projection L' of each abutting region L when the abutting region L and the protrusion section 60 are projected on the virtual line Vt in the second direction (Y-direction) orthogonal to the first direction (X-direction). Moreover, similar to the first embodiment, the direction (second direction) of the virtual line Vt is also not limited to the direction orthogonal to the first direction (X-direction) that is a longitudinal direction and, for example, may be an inclined direction as long as the direction intersects the first direction (X-direction).

In the sixth embodiment described above, similar to the first embodiment, each protrusion section 60 provided in the nozzle plate 72 is formed between the adjacent abutting regions L. Thus, even if the medium 12 that is transported in the Y-direction is curled, since the medium 12 comes into contact with each protrusion section 60 protruding on the liquid ejection side, it is possible that the medium 12 does not come into contact with each abutting region L. Thus, it is possible to achieve the same effects as those of the first embodiment.

The first to sixth embodiments described above are generically represented as a configuration in which the protrusion section 60 protruding from the ejection surface in which the plurality of nozzles N are disposed is disposed, and functions and applications of members forming the ejection surface are unquestioned. Regardless of whether the ejection surface is formed in the fixing plate 38 as the first to fourth embodiments, or the ejection surface is formed in the nozzle plate 72 as the fifth embodiment or the sixth embodiment, various configurations (for example, the shape of the protrusion section 60 and the like) illustrated in each aspect described above are similarly applied.

Modification Examples

The aspects described above can be variously modified. Specific modification aspects are exemplified below. Two or more aspects arbitrarily selected from the following examples may be merged appropriately within a range not mutually inconsistent.

Figure 26:
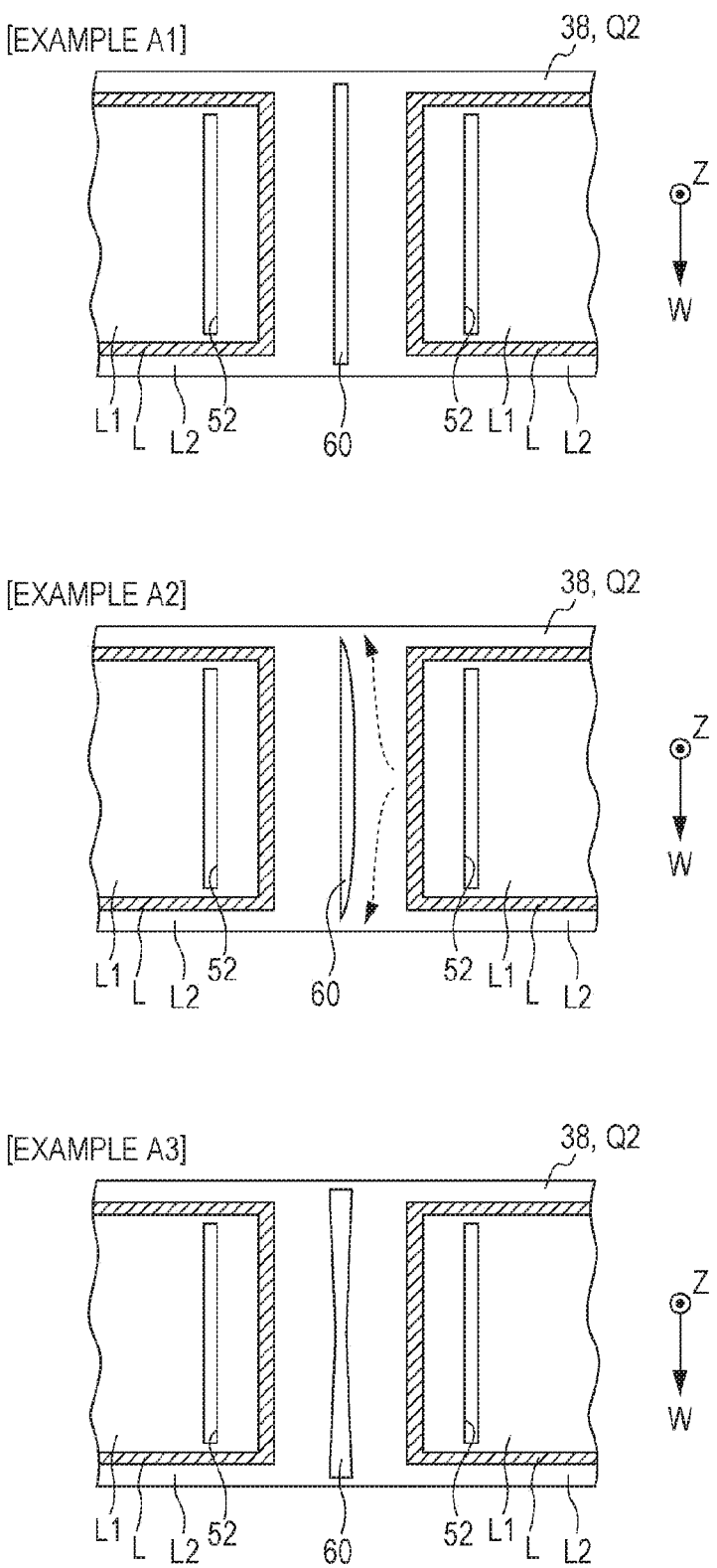
FIG. 26 is an explanatory view of planar shapes of protrusion sections of a modification example.

(1) The planar shape (outer shape of the protrusion section 60 when viewed in the Z-direction) of the protrusion section 60 is not limited to the example of each embodiment described above. For example, the protrusion sections 60 having the planar shape illustrated in FIG. 26 may be formed. The planar shape of the protrusion section 60 of Example A1 is a rectangular shape (rectangular) and the planar shape of the protrusion section 60 of Example A2 is an arcuate shape (crescent). In the configuration of Example A2, when wiping the ink on the ejection surface by moving a wiper (not illustrated) coming into contact with the ejection surface (second surface Q2) in a direction (left direction in FIG. 20) perpendicular to the W-direction, the ink pressed by the wiper moves the positive side and the negative side in the X-direction along the side surface of the protrusion section 60 as indicated by arrows of broken lines in FIG. 26. Thus, there is an advantage that remaining (remaining after wiping) of the ink on the ejection surface is reduced. As illustrated in Example A3 of FIG. 26, it is possible to form the protrusion section 60 having a planar shape in which a lateral width of a center portion is less than those of both end portions in size. Furthermore, a configuration in which a plurality of protrusion sections 60 are arranged in the W-direction may be employed.

Figure 27:
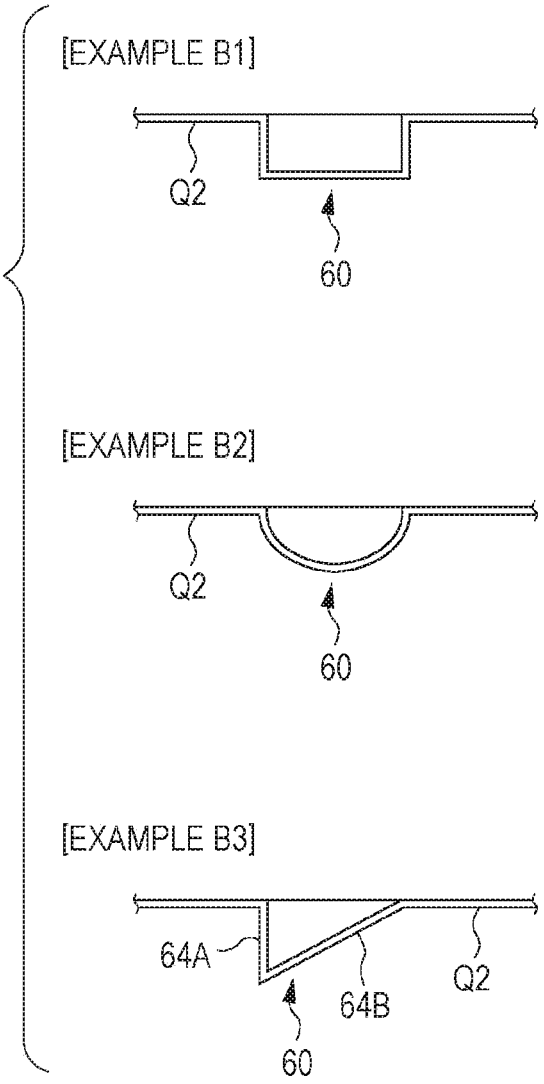
FIG. 27 is an explanatory view of cross sectional shapes of the protrusion sections according to the modification example.

(2) A cross section shape (shape of the surface of the protrusion section 60 within a cross section perpendicular in the W-direction) of the protrusion section 60 is not limited to the example of each embodiment described above. For example, it is possible to form the protrusion section 60 having cross section shapes illustrated in FIG. 27. The cross section shape of the protrusion section 60 of Example B1 is a rectangular shape (rectangular) and the cross section shape of the protrusion section 60 of Example B2 is an arcuate shape. The cross section shape of the protrusion section 60 is not limited to the line symmetrical shape. For example, as illustrated in Example B3 of FIG. 27, it is possible to form the protrusion section 60 having a triangular cross section shape configured of a side surface 64A perpendicular to the ejection surface (second surface Q2) and a side surface 64B inclined to the ejection surface. Moreover, as illustrated in the embodiments, Example B2 and Example B3 of FIG. 27 described above, in the configuration in which the protrusion section 60 includes the inclined surface with respect to the ejection surface, there is an advantage that it is possible to effectively wipe the ink adhering to the ejection surface by the wiper, for example, compared to the configuration of Example B1 of FIG. 27.

(3) In the first to fourth embodiments, the support plate 474 of the compliance section 47 is fixed to the first surface Q1 of the fixing plate 38 in each liquid ejection section 32, but a member connected to the fixing plate 38 in the liquid ejection section 32 is not limited to the support plate 474. For example, in the configuration in which the compliance section 47 is disposed in a place other than a surface facing the fixing plate 38 in the liquid ejection section 32 or in a configuration in which the compliance section 47 is omitted, it is also possible to fix the surface of the flow path substrate 41 on the positive side in the Z-direction in the flow path substrate 41 to the first surface Q1 of the fixing plate 38, for example, using adhesive.

(4) The type of ejecting the ink by the liquid ejection section 32 is not limited to the type described above (piezo type) using the piezoelectric element. For example, the invention can be also applied to a liquid ejecting head of a type (thermal type) using a heat generating element for varying a pressure within a pressure chamber by generating air bubbles within the pressure chamber by heating.

(5) The printing apparatus 10 illustrated in each aspect described above may be employed in various apparatuses such as a facsimile apparatus and a copying machine in addition to a machine dedicated in printing. However, application of the liquid ejecting apparatus of the invention is not limited to printing. For example, a liquid ejecting apparatus ejecting a solution of a color material is used as a manufacturing apparatus for forming a color filter of a liquid crystal display apparatus. In addition, a liquid ejecting apparatus ejecting a solution of a conductive material is used as a manufacturing apparatus for forming a wire or an electrode of a wiring substrate.

What is claimed is:

1. A liquid ejecting apparatus comprising:

a liquid ejecting head including:

an ejection surface which extends in a first direction and a second direction, a plurality of liquid ejection nozzles distributed on the ejection surface, and one or more protrusion sections that are permanently formed on the ejection surface and protrude from the ejection surface in a direction orthogonal to the first direction and the second direction; and a removable sealing body configured to abut an abutting region of the ejection surface and seal the plurality of nozzles by surrounding the plurality of nozzles, the abutting region being different than an area where the protrusion sections are arranged;

wherein the protrusion sections are configured such that (i) at least a first end of a first protrusion section extends beyond the abutting region in the second direction, and a second end of the first protrusion section or (ii) a first end of a second protrusion section extends beyond the abutting region in a direction opposite the second direction.

2. The liquid ejecting head according to claim 1, wherein a plurality of abutting regions are disposed along the first direction, and wherein the protrusion sections are formed between adjacent abutting regions.

3. The liquid ejecting head according to claim 1, wherein a plurality of protrusion sections are formed on the ejection surface, and wherein when each protrusion section is projected along the first direction on a virtual line which extends in the second direction, a continuous imaginary projected line is formed.

4. The liquid ejecting head according to claim 3, wherein the protrusion sections each protrude to a same extent from the ejection surface.

5. The liquid ejecting head according to claim 1, wherein the protrusion sections include protrusion sections that are formed in an inside region surrounded by the abutting region and protrusion sections that are formed in an outside region outside of the abutting region in the ejection surface.

6. The liquid ejecting head according to claim 5, wherein when each protrusion section formed in each of the inside region and the outside region is projected along the first direction on a virtual line which extends in the second direction, a continuous imaginary projected line is formed.

7. The liquid ejecting head according to claim 1, wherein the ejection surface has a nozzle plate in which the nozzles are provided and a fixing plate in which a plurality of opening sections exposing the nozzle plate on the liquid ejection side are provided and which fixes the nozzle plate, and wherein at least one protrusion section of the one or more protrusion sections is formed between at least two opening sections of the plurality of opening sections in the fixing plate.

8. The liquid ejecting head according to claim 7, wherein the at least one protrusion section disposed between at least two opening sections of the plurality of opening sections is the longest of the one or more protrusion sections.

9. A liquid ejecting apparatus comprising:

a transport mechanism configured to transport a medium in a transport direction of the medium; and a liquid ejecting head configured to eject a liquid onto the medium that is transported in the transport direction of the medium, wherein the liquid ejecting head includes:

an ejection surface which extends in a first direction and a second direction, and the transport direction lies in a plane defined by the first direction and the second direction, a plurality of liquid ejecting nozzles distributed in a direction orthogonal to the transport direction of the medium, and one or more protrusion sections that are permanently formed on the ejection surface and protrude from the ejection surface in a direction orthogonal to the first direction and the second direction;

a removable sealing body configured to abut an abutting region of the ejection surface and seal the plurality of nozzles by surrounding the plurality of nozzles, the abutting region being different than an area where the protrusion sections are arranged;

wherein the protrusion sections are configured such that (i) at least a first end of a first protrusion section extends beyond the abutting region in the second direction, and a second end of the first protrusion section or (ii) a first end of a second protrusion section extends beyond the abutting region in a direction opposite the second direction.

10. A liquid ejecting head comprising:

an ejection surface which extends in a first direction and on which a plurality of nozzles ejecting a liquid are distributed; and protrusion sections that are permanently formed on the ejection surface and protrude toward a liquid ejection side in which the liquid is ejected, wherein the ejection surface has abutting regions on which a sealing body that seals the plurality of nozzles by surrounding the plurality of nozzles abuts, the abutting regions being different than an area where the protrusion sections are arranged, and wherein the protrusion sections are disposed such that, when projecting the abutting regions and the protrusion sections along the first direction on a virtual line along a second direction intersecting the first direction, projection of the protrusion sections crosses a boundary of projection of the abutting regions;

wherein the protrusion sections include protrusion sections that are formed in an inside region surrounded by abutting region and the protrusion sections that are formed in an outside region outside of the abutting region in the ejection surface.

11. The liquid ejecting head according to claim 10, wherein when each protrusion section formed in each of the inside region and the outside region is projected along the first direction on the virtual line, a continuous imaginary projected line is formed.

12. A liquid ejecting head comprising:

an ejection surface which extends in a first direction and on which a plurality of nozzles ejecting a liquid are distributed; and protrusion sections that are permanently formed on the ejection surface and protrude toward a liquid ejection side in which the liquid is ejected, wherein the ejection surface has abutting regions on which a sealing body that seals the plurality of nozzles by surrounding the plurality of nozzles abuts, the abutting region being different than an area where the protrusion sections are arranged, and wherein the protrusion sections are disposed such that when projecting the abutting regions and the protrusion sections along a first direction on a virtual line along a second direction intersecting the first direction, projection of the protrusion sections crosses a boundary of projection of the abutting regions, wherein the ejection surface has a nozzle plate in which the nozzles are provided and a fixing plate in which a plurality of opening sections exposing the nozzle plate on the liquid ejection side are provided and which fixes the nozzle plate, and wherein at least one of the protrusion section is formed between at least two opening sections of the plurality of opening sections in the fixing plate.

13. The liquid ejecting head according to claim 12, wherein the at least one protrusion section disposed between the at least two opening sections of the plurality of opening sections is the longest of the plurality of protrusion sections.

* * * * *